United States Patent [19]

Leavell

[11] 4,290,489

[45] Sep. 22, 1981

[54] VIBRATIONLESS PNEUMATIC TOOLS

[76] Inventor: Charles Leavell, 10 Desabla Rd., San Mateo, Calif. 94402

[21] Appl. No.: 125,794

[22] Filed: Feb. 29, 1980

Related U.S. Application Data

[63] Continuation of Ser. No. 534,070, Dec. 18, 1974, abandoned.

[51] Int. Cl.[3] ..... B25D 9/06

[52] U.S. Cl. ..... 173/17; 91/224; 91/234; 60/370; 60/412; 173/119; 173/133; 173/162 R

[58] Field of Search ..... 173/119, 136, 137, 17, 173/162; 92/144, 170; 60/370, 412; 91/224, 234

[56] References Cited

U.S. PATENT DOCUMENTS

| | | | |
|---|---|---|---|
| 638,489 | 12/1899 | Albice | 91/224 |
| 1,154,794 | 9/1915 | Palmer | 60/370 |
| 1,497,635 | 6/1924 | Parrish | 173/119 X |
| 1,691,372 | 11/1928 | Bayles | 173/16 |
| 1,820,872 | 8/1931 | Wyckoff | 92/170 X |
| 1,904,070 | 4/1933 | Morgan | 92/170 X |
| 2,120,546 | 6/1938 | Burt | 60/370 |
| 2,966,776 | 1/1961 | Taga | 60/412 X |
| 3,055,647 | 9/1962 | Morrison et al. | 175/17 |
| 3,490,234 | 1/1970 | Lea | 92/14 X |
| 3,739,862 | 6/1973 | Gunning | 173/16 |
| 3,756,328 | 9/1973 | Sudnishnikov | 173/137 |
| 3,821,992 | 7/1974 | Matsuo | 173/116 |
| 3,826,316 | 7/1974 | Bassinger | 173/17 X |
| 3,866,690 | 2/1975 | Lance | 173/15 |

FOREIGN PATENT DOCUMENTS

| | | | |
|---|---|---|---|
| 755872 | 4/1967 | Canada | 173/DIG. 2 |

*Primary Examiner*—William F. Pate, III

*Attorney, Agent, or Firm*—Haight, Hofeldt, Davis & Jambor

[57] ABSTRACT

A pneumatic system includes a pneumatic motor, which may take the form of a vibrationless paving breaker utilizing a blow-striking member or hammer that is propelled to and from its force-transmitting or blow-striking position by a compressed gas. A valving arrangement provides for relatively large-ratio expansion of the compressed gas in the space under the hammer between its infeed thereinto and its exhaustion therefrom, in order to significantly utilize heat energy in the compressed gas to assist in energizing the propulsion of the hammer. Such heat energy is usually invested in the compressed gas by and during substantially adiabatic compression thereof at a gas-volume transformer, or compressor, included in the pneumatic system. It may be noted that the process of substantially adiabatic compression in the compressor is to a significant degree reversely duplicated in energizing the propulsion of the hammer.

35 Claims, 19 Drawing Figures

VIBRATIONLESS PNEUMATIC TOOLS

This is a continuation, of application Ser. No. 534,070, filed Dec. 18, 1974 now abandoned.

BACKGROUND OF THE INVENTION

1. Field of the Invention

This invention relates generally to a pneumatic motor actuationally utilizing the compressionally induced heat energy of a gas substantially adiabatically compressed by a compressor specialized so that compression of gas therein will approximate ideal adiabatic compression, and more specifically, this invention relates to such a motor and compressor combination wherein the motor has the form of a percussive tool, which may be a vibrationless paving breaker.

2. Description of the Prior Art

Over the preceding years, the present applicant has devoted much time and effort and has made many important inventions, some of which can be truly classified as "breakthrough" inventions, relating to the production of vibrationless pneumatic tools, such as paving breakers. (The term "vibrationless" as employed herein refers to the complete elimination of both sensible and theoretical casing vibration in a tool effectively utilizing a blow-striking element therein.) A number of these inventions have been patented, and reference may be made to the following U.S. Pat. Nos. 2,400,650, issued May 21, 1946; 2,679,826, issued June 1, 1954; 2,730,073, issued Jan. 10, 1956; 2,752,889, issued July 3, 1956; 2,985,078, issued May 23, 1961; 3,028,840, issued Apr. 10, 1962; 3,028,841, issued Apr. 10, 1962; 3,200,893, issued Aug. 17, 1965; 3,214,155, issued Oct. 26, 1965; 3,255,832, issued June 14, 1966; 3,266,581, issued Aug. 16, 1966; 3,291,425, issued Dec. 13, 1966; and 3,295,614, issued Jan. 3, 1967. Of particular interest is U.S. Pat. No. 3,200,893, in which an exhaustive discussion of the principles involved in applicant's production of vibrationless pneumatic tools is presented.

Apart from applicant's own efforts, as exemplified to some degree by the patents identified above, the vibration referenced emphasis in the field of pneumatic percussive tools has been upon reduction of vibration, in contradiction to the complete elimination of vibration sponsored by applicant in his basic approach. Accordingly, while applicant's approach results in completely vibrationless operation, the other prior art approaches have, at best, merely reduced the degree of practically occurrent vibration, which still remains at a very undesirable high level.

In prior art percussive tools, both vibrating and vibrationless, the actuating compressed gas (normally compressed air) is delivered to and utilized in the tool at a temperature in the vicinity of the ambient temperature. Therefore, there has been a very costly loss of potentially available actuating energy, due to the technologically traditional discarding of the heat energy produced in and during compression of the gas, by design deliberately directed to avoiding expansion of the compressed gas in the tool, thus rendering the system inherently inefficient.

As an informing quantitative illustration of this fact, attention is directed to the long-existing extreme contrast between the usefully transmitted mechanical-power results of actuative investments, respectively, of 100 mechanical horsepower, in an electrical generator for reclamation by and after copper wire delivery to electric motors, and in an air compressor for reclamation by and after conduit or hose delivery to pneumatic motors, the electric-motor-reclaimed mechanical power approximating 90 horsepower as against pneumatic-motor-reclaimed mechanical-power values usually in, and sometimes falling below, the range between 10 and 20 horsepower. An, because of the illustrative emphasis given herein to pneumatic motors in the particular form of hand-held pneumatic paving breakers, it is of interest to note that, in prior art pneumatic mechanical-power transmission systems consisting of compressor and hose components supplying compressed air to motor components of this particular form, the pneumatically transmitted mechanical power output resulting from such a 100-horsepower input normally does not exceed this astonishingly low 10-horsepower value, and not infrequently, in cases of field work with old and worn compressor, hose, and tool components, may decline to 8 or even to 6 horsepower.

It is not too much to say that this order-of-10 disparity between the corresponding overall efficiencies of such electric and pneumatic mechanical-power transmission systems, thus respectively approximating 90% and 10%, is the principal reason for the prior and contemporary failure of such pneumatic systems (notwithstanding their great special advantages in completely eliminating the fire and shock-hazard factors normally attending the use of the electric systems, and also in affording motor components that are uniquely superior in the respects of work-output/weight, work-output/-size, and work-output/cost ratios) to generally replace such electric systems in the shop and factory market therefor which, contemporaneously and on a world sales basis, is approaching one-and-a-half billion dollars per year.

As a variant and purely qualitative expression of this very suggestive information, it is expected that the elimination of this existing order-of-10 inferiority of pneumatic mechanical-power transmission system efficiencies to electric mechanical-power transmission system efficiencies resulting from the practical equating of such pneumatic system efficiencies to such electric system efficiencies by the breakthrough achievements herein disclosed will result (inevitably, in view of the great special advantages of such pneumatic over such electric systems parenthetically recited in the preceding paragraph) in the commencement of so great an enlargement of world use of such pneumatic systems in shop and factory and in various other and actually much more extensive spheres of practical application therefor as to fully justify description of such very great enlargement of pneumatic power transmission use as constituting the innovation of a long overdue Pneumatic Age.

The foregoing remarks relevant to the employment of compressors to produce gaseous pressures for, and therefore adequate for, the practically useful actuation of pneumatic motors, illustratively and particularly in the form of pneumatic percussive tools, yet more particularly represented by vibrationless hand-held-pneumatic paving breakers, and especially relevant to and emphasizing the very low overall pneumatic efficiency of a typical system, made up of a compressor, a practically useful form of pneumatic motor, and a hose delivering actuating gas thereto at a pressure raised above ambient value by the compressor component of the system, and purposefully and successfully designed in accordance with the traditional technical ideal of avoiding expansion of the actuating gas in such motor component of the system, quite strongly suggest the desirability, at this point in explaining the background of the invention, of more particularly explaining how this traditional but mistaken ideal, principally responsible for delaying innovation of such Pneumatic Age throughout the first century of the history of the compressor and pneumatic tool industry, could ever have come to be adopted by it as its ruling principle of thermodynamic design.

In this connection it will be readily understood that, because early compressor types were heavy and only inconveniently portable between different particular working sites on any extensive project area, the use of relatively long hoses to connect easily hand-portable pneumatic tools to such inconveniently movable compressors, being the obvious alternative to frequently undergoing the inconvenience of moving the compressors, very early and widely became customary practice in project areas where compressor, hose, and pneumatic tool systems were being practically applied.

It was then found that the rate of heat transfer, through the walls of such long hoses and between compressed air flowing therein and ambient air, was generally sufficient to cause delivery of such compressed air, to the tool to be actuated thereby and regardless of its temperature of entrance into the remote other end of the hose connected to the compressor, at a temperature only unimportantly different from the temperature of the casing and interior of the tool being maintained by contact with ambient air approximately at ambient temperature. And under these conditions it was readily determined that the horsepower requirement for operating the compressor to deliver compressed air to the tool at any chosen actuating pressure and thus unavoidably at approximately ambient temperature, and at any specific pounds-per-minute rate in order to obtain a desired work-rate from the tool, could be significantly reduced by purposeful design of the compressor to reduce the disparity between the actual compression process and ideal isothermal compression at the ambient temperature.

A corollary to the general acceptance of this objective of design was a passive and continuing general acceptance of the described condition of delivery of the actuating compressed air to the tool at approximately ambient temperature, which in turn imposed the still generally accepted prohibition on design that it not permit substantial expansion of the actuating compressed air in the tool which would so reduce the temperature of such air in passing through the tool as to produce highly objectionable degrees of refrigeration therein. In recent years, one of the leading compressor and pneumatic tool manufacturers published a list of 14 impairments of tool operation which such refrigeration in the tool would usually or could sometimes produce. As examples, a not very extreme degree of refrigeration would result in liquefaction of the moisture content of the compressed air into water streaking and breaking the oil film on the internal cylinder surface of the tool, leading to rapid wear and impaired hammer-piston seal on cylinder surface areas thus deprived of effective oil lubrication, while more extreme degrees of such refrigeration could destroy all lubricative action, and therefore prevent free sliding hammer-piston motion, by solidifying the oil film, and, under certain atmospheric conditions, would stop operation of the tool entirely by converting moisture content of the compressed air into an ice plug completely blocking the exhaust port of the tool.

And this generally accepted prohibition against expansion, of the compressed air in the tool, by preventing reclamation by it of the major investment of mechanical energy in compressing air to a smaller volume in the compressor (called the energy of compression), limits the mechanical energy obtained by the tool from compressed air passing through it to the minor investment of mechanical energy made by the compressor piston (called the pumping energy) in pumping compressed air out of the compressor cylinder, without further reduction of the volume thereof, into and against the compressed air pressure effective through the receiver and/or hose.

In brief, then, the century-old commitment of the compressor and pneumatic tool industry to not reclaiming the much larger energy of compression in the tool, but instead actuatively employing in it only the much lesser pumping energy, is the principal reason for the continued survival of the hereinbefore specified, astonishingly low, overall pneumatic mechanical-power transmission efficiencies of the order of 10%.

SUMMARY OF THE INVENTION

The present invention improves upon applicant's prior art vibrationless pneumatic tools and obviates the inherent inefficiency of all prior art pneumatic systems. Although the preferred embodiment disclosed herein is that of a vibrationless pneumatic paving breaker, it should be recognized that reference to the paving breaker or specific features thereof will be generally applicable to all vibrationless percussive tools covered hereby, as well as frequently applying to the field of pneumatic motors generally.

In the preferred embodiment disclosed herein, the vibrationless pneumatic paving breaker has a generally cylindrical outer casing with an annular cross-section. A central round bar or rod is located in and coaxial with the casing, and a generally cylindrical blow-striking member or hammer having an annular cross-section is positioned for reciprocable motion along the round rod within the casing. A generally annular shoulder is located on the inner surface of the casing intermediate the ends thereof. The hammer or blow-striking member slides along the shoulder during its reciprocable motion. One end of the blow-striking member or hammer is adapted to engage a work member (tool bit or work bit). Adjacent the end of the hammer that contacts the tool bit, there is located an annular projecting portion that engages the inner surface of the casing with a sliding fit. A compressed gas (usually air) actuating chamber is formed in the space between the projecting portion and the shoulder. An appropriate conduit is utilized to insert compressed gas into the actuating chamber.

A cavity is formed in the end of the round rod adjacent the work bit. The round rod and this cavity both extend into the work bit itself. A portion of this cavity in the work bit, and in the part of the rod adjacent the work bit, is enlarged to accept a valve assembly, the mounting arrangement and spring bias for which are located in the work bit. This enlarged portion of the cavity has a control opening at the bottom of the hammer and a vent opening in the work bit. The valve assembly interacts with the control opening to regulate passage of actuating compressed air to and venting (in order to exhaust the actuating gas) of the space under the hammer. A compressed air passageway is located at the other end of the cavity. This compressed air passageway opens into an annular chamber formed in the hammer, which is connected to the actuating chamber by another passageway, for a short length of the hammer.

Inasmuch as the work bit is free to move with respect to the casing, it is necessary to provide for holding the work bit in conjunction with the casing. To achieve this, a restraining device, such as somewhat resilient restraining arms engaging the work bit and passing over the other end of the tool, may be utilized.

By appropriate actuation of the valve assembly, a short burst or pulse of compressed air at a temperature above ambient temperature is inserted under the hammer where it expands to drive the hammer away from the work bit. Appropriate regulation of the duration of this burst of compressed air results in the hammer being driven to the end of the casing away from the work bit, at which point the momentum of the hammer is offset by the pressure of the compressed gas in the actuating chamber. The heat energy in the gas provides the energy of expansion. The hammer is then driven toward the work bit by the compressed air in the actuating chamber, while the valve assembly is appropriately positioned to vent the space under the hammer to atmosphere in order to exhaust the expanded air.

In this fashion, a vibrationless pneumatic tool is provided in which the hammer acts against a constant force produced by the compressed gas in the actuating chamber in transmitting an external force against the casing, and in which actuation of the hammer during the motion away from the work bit (return stroke or upstroke), may be easily and accurately controlled. In addition to vibrationless operation, this tool also virtually eliminates exhaust noise, since the exhaust is achieved at ambient temperature and pressure. In view of the very small number of parts required to construct this device, a vibrationless pneumatic tool has been provided which not only operates in an effective and easily controlled fashion, but which is also very practical for manufacturing purposes.

The vibrationless pneumatic tool described above works very efficiently by utilizing the heat developed during compression of the gas to aid in driving the tool, as opposed to conventional discarding of this heat energy. In other words, by a substantially adiabatic compression of the gas from ambient temperature and pressure, with a substantially adiabatic expansion and cooling of the gas in the tool, effective utilization of the heat energy is achieved. To achieve these desired results, it is desirable to insulate the tool to permit the desired adiabatic expansion. Of course, with such an arrangement the work output of the tool is increased, and hence even if an adiabatic compressor is not available, it may be desirable to utilize a heated compressed gas, such as by utilizing an after heater with a conventional compressor.

In order to achieve the desired adiabatic compression, a very significant step forward in the art has been achieved by the development of the adiabatic compressor disclosed herein. While primary emphasis shall be placed upon the utilization of this device as an adiabatic compressor, it should be recognized that the device will work equally well as an adiabatic expansion arrangement or pneumatic motor, and, therefore, it has been termed an adiabatic gas-volume transformer. As a matter of fact, it should be noted that the pneumatic tool itself serves as an adiabatic expansion device or pneumatic motor, and hence is a particularized form of the adiabatic gas-volume transformer.

In the preferred embodiment of the adiabatic gas-volume transformer disclosed herein, which is shown in its utilization as a compressor, a movable member or piston is mounted for reciprocable motion in a casing. A first portion of the piston is arranged to move in a gas mass confining area or energy conversion chamber to vary the volume of the gas therein. In the preferred embodiment disclosed herein, the energy conversion chamber has a generally cylindrical shape with a hemispherical end, which matches the shape of the casing, but, of course, various other shapes could also be utilized. Heat migration or heat loss preventing steps are required to prevent heat loss from the energy conversion chamber during operation of the gas-volume transformer. Any appropriate type of heat migration preventing approach may be utilized, such as a very high speed of operation, but in this preferred embodiment, the heat migration preventing structure involves insulating material placed about the first portion of the piston and in the casing about the energy conversion chamber.

An appropriate valving arrangement is required to control the flow of gas to and from the energy conversion chamber. In this particular example, two valves are utilized, one of such valves providing a conduit to the atmosphere, with the other valve providing a conduit to a reservoir or tank of heated compressed gas. Any appropriate type of control for these valves may be utilized, such as a cam arrangement, but in the case of compressor operation, appropriate biasing springs may be utilized to yield the desired control.

A second portion of the piston is arranged to have a sliding fit with the inner surface of the casing. This second portion is integrally connected to the first portion, and to a piston drive shaft which extends in the opposite direction from the first portion of the piston. The second portion of the piston provides support for the piston and contains piston or retaining rings for carrying lubricant during operation of the transformer. In order to reduce the friction losses as much as possible, it is desirable to eliminate the side thrust experienced by the second portion of the piston. To achieve this, an appropriate guide structure, such as a spider arrangement, positions the piston drive shaft. The piston is then reciprocated through mechanical energy applied to the drive shaft, such as by a double-throw crank arm arrangement. The guide or spider structure also permits the first portion of the piston to move in the energy conversion chamber without contacting the surface thereabout, although being in very close proximity thereto.

By utilization of the structure disclosed herein, a very small portion of the heated gas in the energy conversion chamber is in the vicinity of the piston rings at the point of maximum temperature in the transformer (i.e., when the piston has decreased the gas containing volume of the energy conversion chamber to its greatest extent). This permits cooling of the gas in the vicinity of the piston rings without affecting the temperature of the gas in the highest temperature or active area of the energy conversion chamber. This is achieved by a suitable cooling means, such as a water bath located in the casing, which also cools the piston rings during the entire extent of their motion. This is very important, as the very high temperatures that may be reached in the energy conversion chamber can otherwise vaporize the lubricant, such as oil, utilized in connection with the second portion of the piston.

Therefore, a very efficient pneumatic tool system is provided. As part of the system, an extremely efficient adiabatic gas-volume transformer has been introduced, so that the hitherto unapproachable dream of 100% efficiency from initial mechanical energy input to ultimate mechanical energy output is substantially realized.

These and other objects, advantages and features of this invention will hereinafter appear, and for purposes of illustration, but not of limitation, an exemplary embodiment of the present invention is shown in the appended drawing.

DETAILED DESCRIPTION OF THE PREFERRED EMBODIMENT

Figure 1:
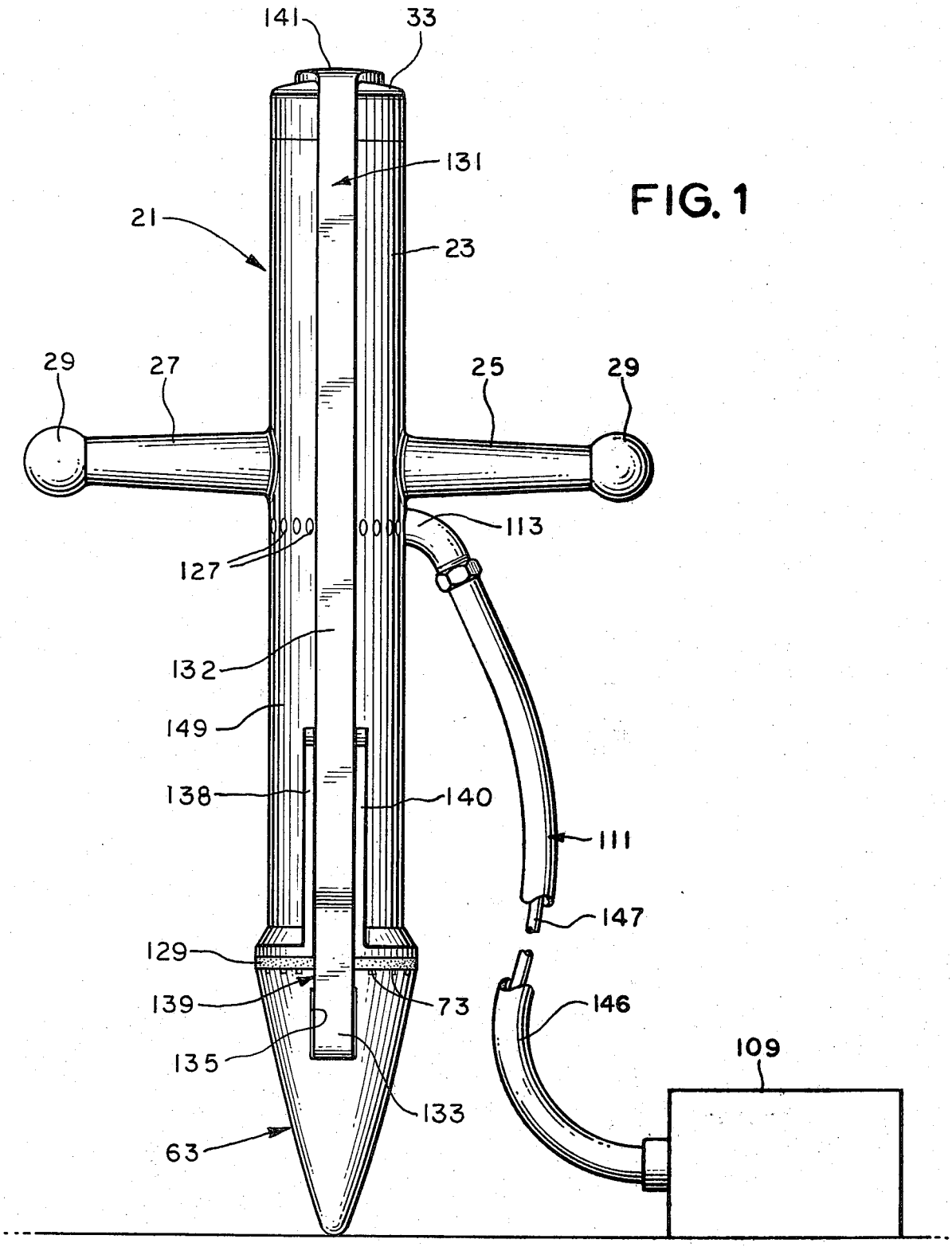
FIG. 1 is an elevational view of a pneumatic tool system constructed in accordance with the present invention.
Figure 2:
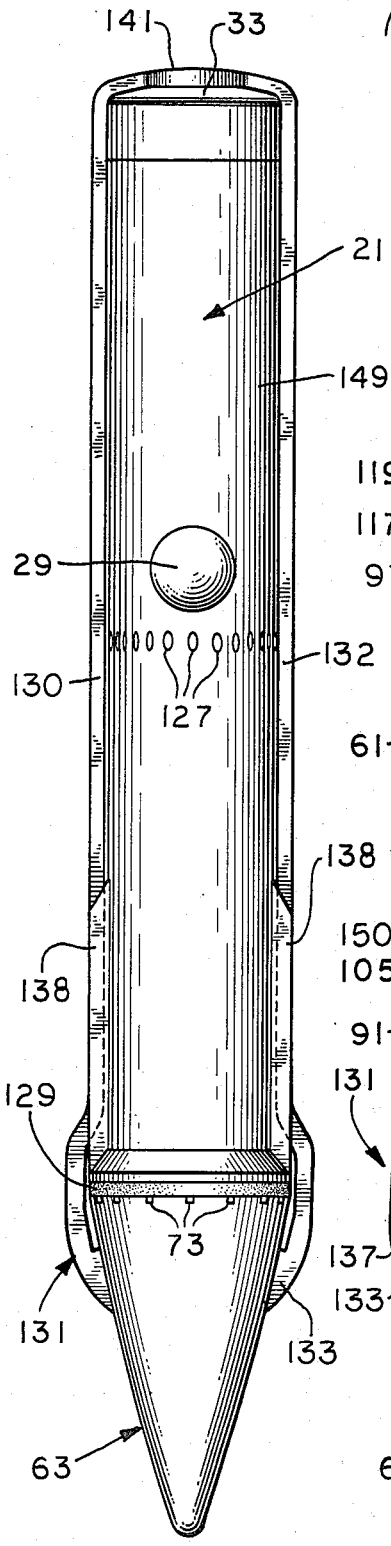
FIG. 2 is a left side elevational view of the pneumatic tool of FIG. 2.
Figure 3:
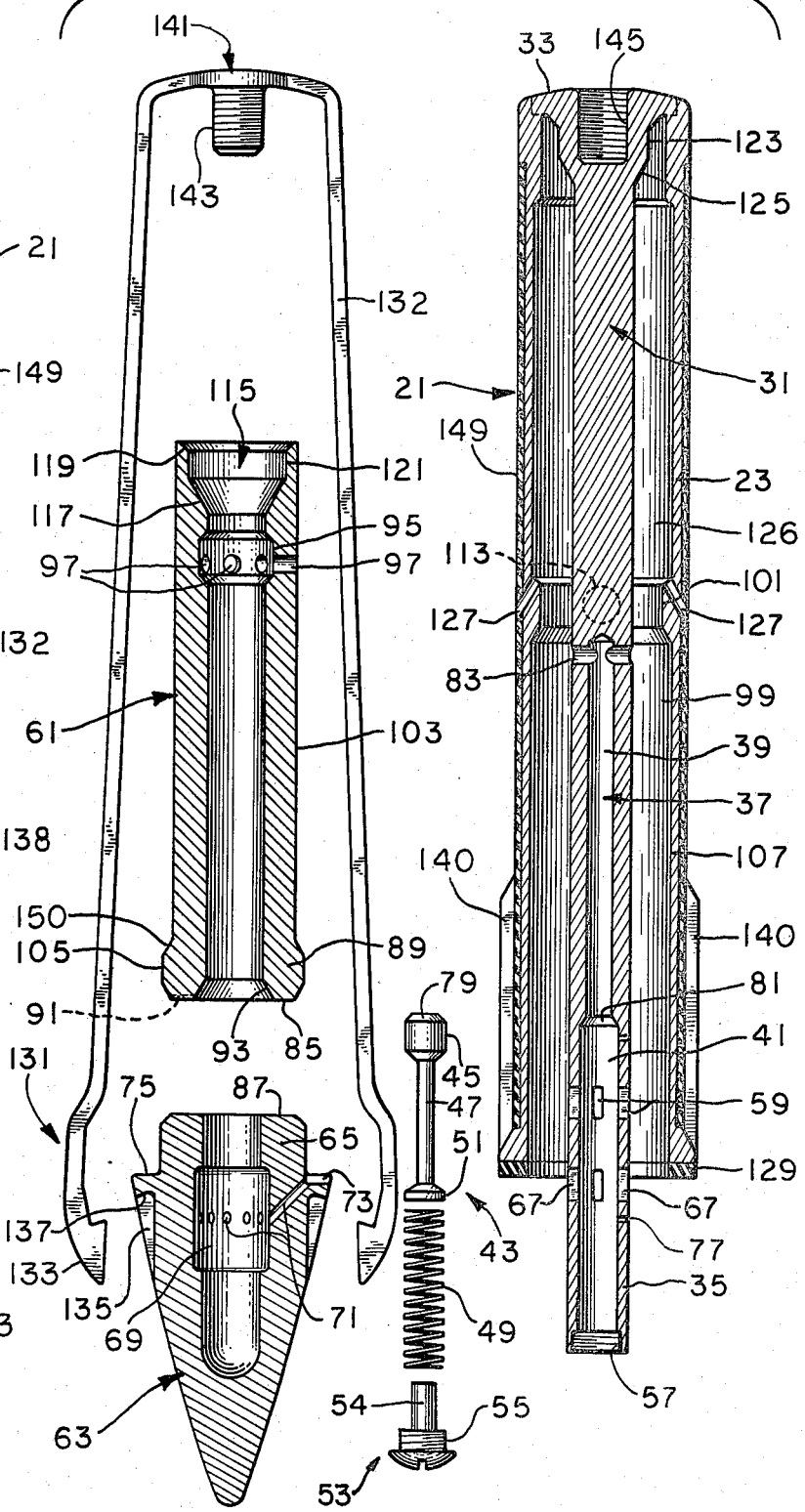
FIG. 3 is an exploded view of the pneumatic tool of FIGS. 1 and 2, partially in elevation and partially in cross-section.

With reference now to FIGS. 1–3, a vibrationless pneumatic tool 21 constructed in accordance with the present invention is disclosed. While this invention is in no way limited thereto, the preferred embodiment of the pneumatic tool 21 disclosed herein is that of a paving breaker. Hence, the pneumatic tool 21 shall also be interchangeably referred to herein as a pneumatic paving breaker or paving breaker 21.

Paving breaker 21 has an outer casing 23, to which are attached handles 25 and 27. Casing 23 is any suitable strong material, usually a metal and usually steel, while handles 25 and 27 also require a strong material, again frequently steel. Handles 25 and 27 are securely affixed to casing 23 to support the weight of the operator bearing thereupon during operation. Handles 25 and 27 may be located at any appropriate place on casing 23, but the location shown in FIG. 1 is particularly useful for this type of tool. As a result of the elimination of vibrations, and the location of handles 25 and 27, the operator may lean his chest upon the top of the paving breaker 21 to exert a greater force on casing 23 with less effort than in conventional devices, where the handles are located near the top of the paving breaker. It should also be noted that handles 25 and 27 have ball-like protruberances 29 at the outermost ends thereof, as this type of structure has been found to be more easily grasped by an operator than conventional handles.

A central round rod 31 extends along the central axis of casing 23 and is coaxial therewith. Round rod 31 includes a heat portion 33 that closes one end of the casing 23. The head portion 33, and hence the round rod 31, may be integrally formed with casing 23 or integrated therewith by any suitable method, such as by welding in a fashion that does not distort the casing 23. The other end 35 of round rod 31 extends beyond the other end of casing 23.

A cavity 37 is formed in round rod 31 and extends a predetermined distance inwardly from end 35 of the rod. The cavity 37 includes a relatively small diameter portion 39 and a somewhat larger diameter portion 41.

A valve assembly 43 is located in the enlarged portion 41 of cavity 37. Valve assembly 43 includes a valve body 45 with a valve stem 47. A bias spring 49 is connected to a base 51 attached to valve stem 47. A screw member 53 mounts the valve assembly 43 in portion 41 of cavity 37, with bias spring 49 extending over a leg 54 of member 53. Threads 55 on screw member 53 mate with corresponding threads 57 on end 35 of round rod 31. Therefore, during assembly of the tool, the valve assembly 43 may be inserted into portion 41 of cavity 37 for mounting therein by the screw member 53.

The valve body 45 is moved with respect to a series of control or adjusting openings 59, which selectively supply an actuating compressed gas to a blow-striking member, or hammer, 61 and vent the space under the hammer 61. The control or actuating openings 59 are spaced about the circumference of the round rod 31 in any desired number, although in this preferred embodiment a total of four actuating openings 59 have been found suitable. The bottoms of actuating openings 59 are aligned with the top of a work member (also referred to herein as a work bit or tool bit) 63, when the tool 21 is in the operative position illustrated in FIGS. 5–13. The tool bit 63 has a neck 65 which is inserted into casing 23.

The end 35 of round rod 31 extends into the work bit 63. Vent openings 67, generally corresponding to the actuating openings 59, extend from portion 41 of cavity 37 to a chamber 69 formed in work bit 63. Passageways 71 connect chamber 69 to ambient conditions, normally atmospheric. Grooves 73 formed in a shoulder 75 of work bit 63 provide top portions of passageways 71. Another vent opening 77 connects cavity 37 with chamber 69 to provide venting of the space about stem 35 of rod 31 during the at-rest or standby position of FIG. 4, since the upward movement of casing 23 results in vent openings 67 being blocked off from chamber 69 by work bit 63.

In the standby condition, valve body 45 is biased to the top of portion 41 of cavity 37 by the spring 49. A frusto-conical portion 79 of valve body 45 mates with a shoulder 81 at the top of portion 41 to limit the extent of movement of valve body 45 in that direction. In this position, the space between the top of neck 65 of work bit 63 and the bottom of hammer 61 is vented through openings 59, along valve stem 47 to openings 67, through chamber 69 and passageways 71 to atmosphere. When compressed air is inserted into portion 39 of cavity 37, through openings or passageways 83, valve body 45 is moved against the force of spring 49 to permit the compressed air to pass through openings 59 and under hammer 61 to drive the hammer 61 away from work bit 63. At the same time, the vent path previously described is blocked. In this fashion, the valve body 45 selectively permits compressed air to be inserted into the space under hammer 61, or causes that space to be vented or exhausted to ambient or atmosphere.

The hammer 61 is a generally cylindrical body with an annular cross-section and is formed of a suitably hard material to deliver blows to the work bit 63. An actual blow-delivering face 85 strikes a blow-receiving surface 87 on the top of neck 65 of work bit 63. Blow-delivering face 85 is the outermost extension of an enlarged portion 89 of the hammer 61. In order to increase the surface exposed to compressed air at the time that face 85 bears against surface 87, radial grooves 91 may be formed in face 85. In addition, a frusto-conical surface 93 is formed at the inner bottom of portion 89 to provide a surface for the compressed air to bear against at the time that face 85 and surface 87 are in contact, as well as during the return or up-stroke of hammer 61.

A chamber 95 in the hammer 61 is connected to compressed gas through openings or passageways 97. Seven such openings or passageways 97 have been found preferable, although any suitable number may be utilized. The compressed gas inserted through openings or passageways 97 comes from an actuating chamber 99 that is formed between enlarged portion 89 on hammer 61 and a projecting shoulder 101 formed on the inner surface of casing 23. The outer surface 103 of hammer 61 is adapted to pass through shoulder 101 with a tight sliding fit. Similarly, the outer surface 105 of enlarged portion 89 of hammer 61 is adapted to ride along the inner surface 107 of casing 23 with a tight sliding fit. Thus, the variable volume actuating chamber 99 is provided. Appropriate seals (not shown) may be utilized to insure that there is no gas leakage from actuating chamber 99. Compressed gas is passed to actuating chamber 99 from a suitable source 109 thereof through a line 111 to an opening 113 in casing 23. In this preferred embodiment, compressed gas is provided to the tool 21 at temperature somewhat in excess of 200° Fahrenheit, so that the gas may be expanded and the heat energy in the compressed gas utilized to drive the hammer 61, and thus greatly increase the efficiency of the pneumatic system. The heat energy in the compressed gas from source 109 may be developed by means of an adiabatic compressor of the type disclosed hereinafter, or by any other suitable means, such as a conventional approximately isothermal compressor with an after-heater.

At the end of the hammer away from enlarged portion 89, there is located an opening 115 that has frusto-conical portions 117 and 119 and a connecting cylindrical portion 121. When the hammer 61 approaches the head portion 33 at the top of casing 23, the surface about cylindrical portion 121 engages a shoulder 123 on round rod 31, while the surface of portion 117 approaches a shoulder 125, also on round rod 31. The engagement between the surface of cylindrical portion 121 and shoulder 123 is a tight sliding fit, so that a gas-tight space is formed between the surface of portion 117 and shoulder 125. This provides a gas or air cushion that prevents the hammer 61 from stroking against the casing 23 with a metal to metal contact.

The space 126 above the hammer 61 is vented to atmosphere at all times by openings 127, so that no pressure is developed above hammer 61, except for the gas cushion between the surface of frusto-conical portion 117 and shoulder 125. Again, any appropriate number of openings 127 may be utilized, but it has been found that forty such openings provide the desired amount of venting in this embodiment. Although these forty openings are not specifically disclosed in FIGS. 1–3, schematic representations thereof are shown in FIGS. 1 and 2.

The work bit 63 has the neck 65 thereof positioned in casing 23 for reciprocable motion therein. When casing 23 is urged toward work bit 63, the shoulder 75 of the work bit 63 bears against a resilient member 129 connected to the bottom of casing 23. However, when work bit 63 is struck by the hammer 61, the work bit 63 may be driven away from casing 23 so that shoulder 75 no longer bears against resilient member 129. In some cases, the separation could become great enough that the work bit would become completely separated from the casing 23, thus causing loss of operating ability with, perhaps, attendant damage to the tool 21. Also, the work bit 63 would become separated from tool 21 during the standby or at-rest condition. Therefore, a restraining device 131 is utilized to prevent work bit 63 from separating too far from casing 23. Restraining member 131 has a pair of somewhat resilient arms 130 and 132, each of which has a hook-type end members 133, which fit in corresponding slots 135 in the tool bit 63. As tool bit 63 is driven away from casing 23 by the impact of a blow, or by cessation of the force exerted by the operator on casing 23, the end members 133 engage the surface 137 at the tops of slots 135 to limit the amount of separation between the work bit and the casing.

In order to prevent rotation of the work bit 63 during operation, the restraining member passes through a structure 139 on the casing 23, which holds the restraining member arms 130 and 132 from twisting. Structure 139 includes a pair of holding members or ears 138 and 140 on opposite sides of casing 23.

A suitable fastening device, such as a bolt-like portion 141, may be utilized to secure the restraining member to the top of casing 23. Threaded portion 141 is integrally connected to the restraining member 131. Threads 143 on the bolt-like portion 141 mate with corresponding threads 145 in head portion 33 of round rod 31. To attach or disattach restraining member 131 from tool 21, arms 130 and 132 are spread to the position illustrated in FIG. 3 and the whole member 131 is rotated. With the resilient arms 130 and 132 released to return to the position of FIG. 1 or FIG. 2, the restraining member 131 is locked on tool 21 and held by ears 138 and 140 and the sides of grooves 135.

While the structure of the tool 21 disclosed herein could be utilized with an actuating compressed gas at ambient temperature, the operation of the tool is premised upon the expansion of the gas under hammer 61, and thus heat would have to be provided to prevent a refrigerating effect. The most efficient way to accomplish this, which also tremendously increases systems efficiency, is to utilize the heat energy produced during compression of the gas. Accordingly, in the preferred embodiment, the source of gas 109 would be a substantially adiabatic compressor. The heated compressed gas would then be conveyed to tool 21, such as by a short hose or conduit 111. Hose 111 is preferably formed to prevent heat migration or loss, such as by use of an inner gas conveying tube 147 and an outer tube 146. The air space therebetween will provide the desired insulation. Of course, with such an insulated hose 111, the length thereof can be increased to any desired length.

One of the major difficulties with a heated actuating gas is that the lubricant in the tool may be vaporized. In the preferred embodiment disclosed in FIGS. 1–3, the gas is used at a low enough temperature to preclude vaporization of the oil or other lubricant. Also, the tool 21 may be operated without insulation, but in a desirable form rubber insulation 149 may be utilized. Such a rubber coating on casing 23 prevents heat loss and also permits use of a thinner-walled casing 23, due to the greater resiliency provided by rubber coating 149.

Figure 4:
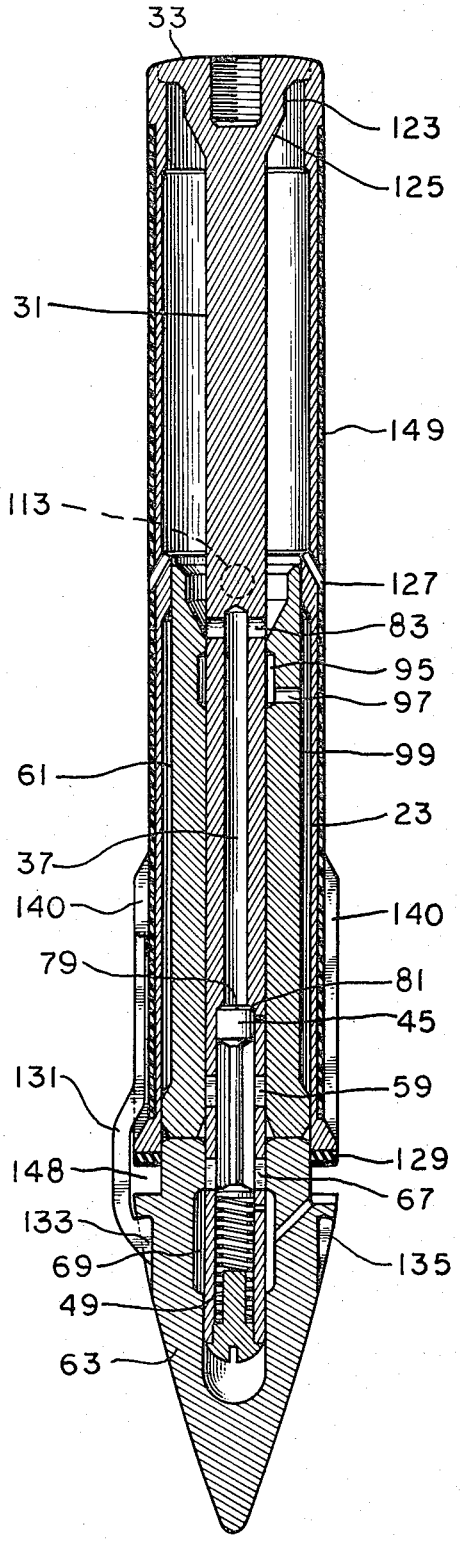
FIGS. 4–13 are a series of views of the pneumatic tool of FIGS. 1 and 2, partially in elevation and partially in cross-section, illustrating the sequence of operation of the pneumatic tool.

By reference now to FIGS. 4–13, the operation of the pneumatic tool disclosed herein may be followed in detail. With reference to FIG. 4, the tool is shown in the at-rest or standby position. It may be seen that work bit, 63 is spaced from the casing 23 by a gap 148, which is the maximum amount of separation permitted by the restraining member 131. As shown, the hooked end portions 133 of the restraining member 131 engages the top surfaces 137 of grooves 135 to limit the separation of tool bit 63 from resilient member 129 of casing 23. (For purposes of the views of FIGS. 4–13, the restraining member 131 is only illustrated in fragmentary detail.) At this point, the chamber 95 is below the passageway 83, so that no compressed gas bears against valve body 45. Hence, the spring 49 maintains the valve body 45 at the maximum distance away from the work bit 63 (with section 79 abutting shoulder 81).

Figure 5:
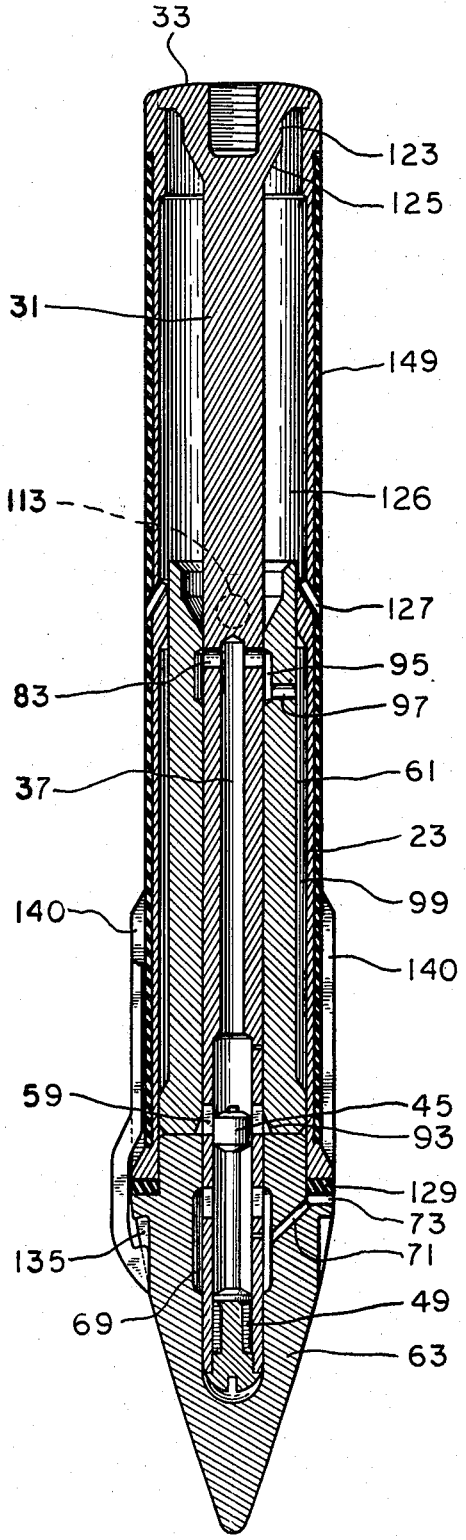

In FIG. 5, the tool 21 is put into an operative state by an operator putting force against casing 23 to bring the resilient member 129 into contact with tool bit 63. In this position, the chamber 95 in the hammer 61 is aligned with passageway 83, so that compressed air from the actuating chamber 99 is conveyed to cavity 37 and forces valve body 45 to the position shown, against the force of bias spring 49. In this position, the valve body 45 blocks the openings 59 from the atmosphere and permits the compressed gas to enter under hammer 61. The initial effect on the hammer 61 during the return or up-stroke is aided by the grooves 91 and the frusto-conical surface 93. The openings 127 serve, of course, to vent the space 126 above hammer 61 to ambient or atmosphere at all times, so that there is no compression of the air in that space to impede the hammer on its return stroke, other than the small air cushion at the end of the return stroke.

Figure 6:
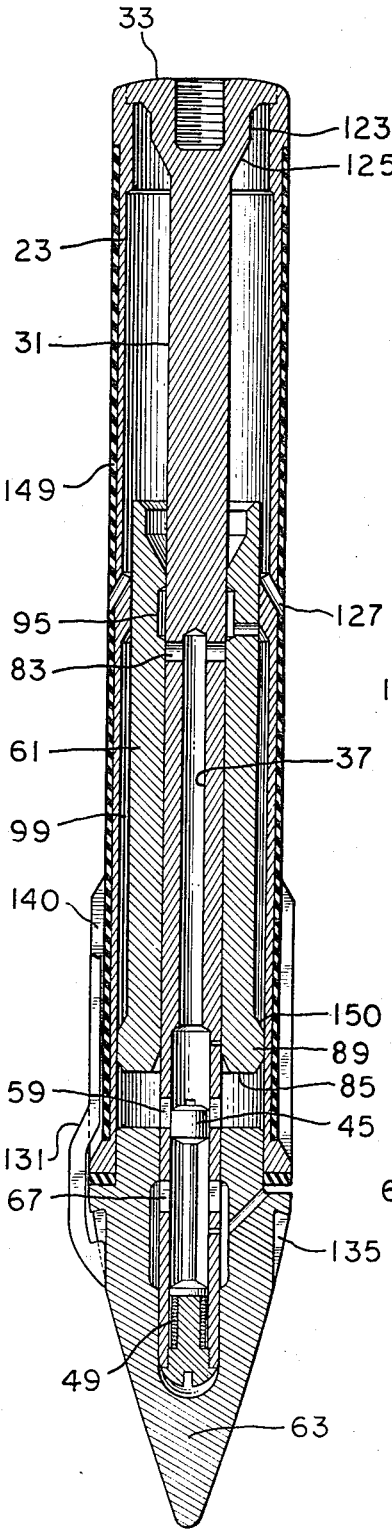

FIG. 6 depicts the hammer 61 as being propelled upwardly so that chamber 95 is no longer in association with passageway 83. Thus, no more compressed gas is being conveyed to the cavity 37. The length of chamber 95 is carefully determined, and based upon the speed of the hammer 61 on the return stroke, so that the pulse or slug of compressed air applied to the relatively large surface 85 at the bottom of hammer 61 supplies just enough energy to carry the hammer to the end of return stroke position, against the force exerted by the compressed gas in chamber 99 against a surface 150 of enlarged portion 89 of hammer 61. As the chamber 95 has just separated from passageway 83, the valve body 45 is still in the position of FIG. 5.

Figure 7:
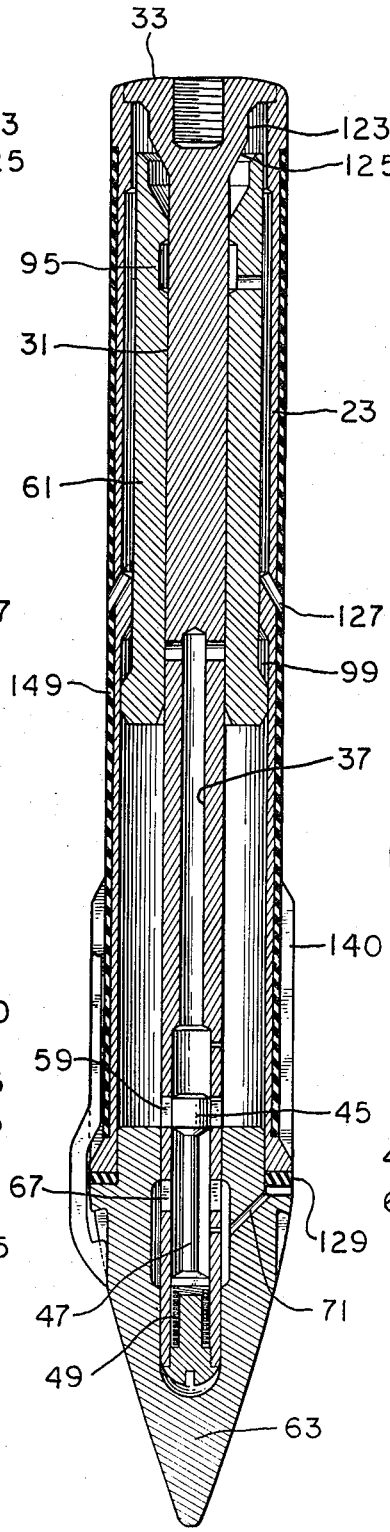

In FIG. 7, the hammer 61 is approaching the end of the return stroke (top-of-stroke) position and is slowing down pursuant to an imminent change in the direction of momentum. The valve body 45 has now moved to the position that it completely closes openings 59, so that the only gas or air under hammer 61 is the initial pulse of compressed gas that was inserted at the beginning of the return stroke. This pulse of gas is expanding to propel the hammer 61, with the heat energy in the compressed gas providing the energy of expansion in order to permit the gas to be exhausted at ambient temperature and pressure, which eliminates exhaust noise, as well as providing a very efficient operation.

Figure 8:
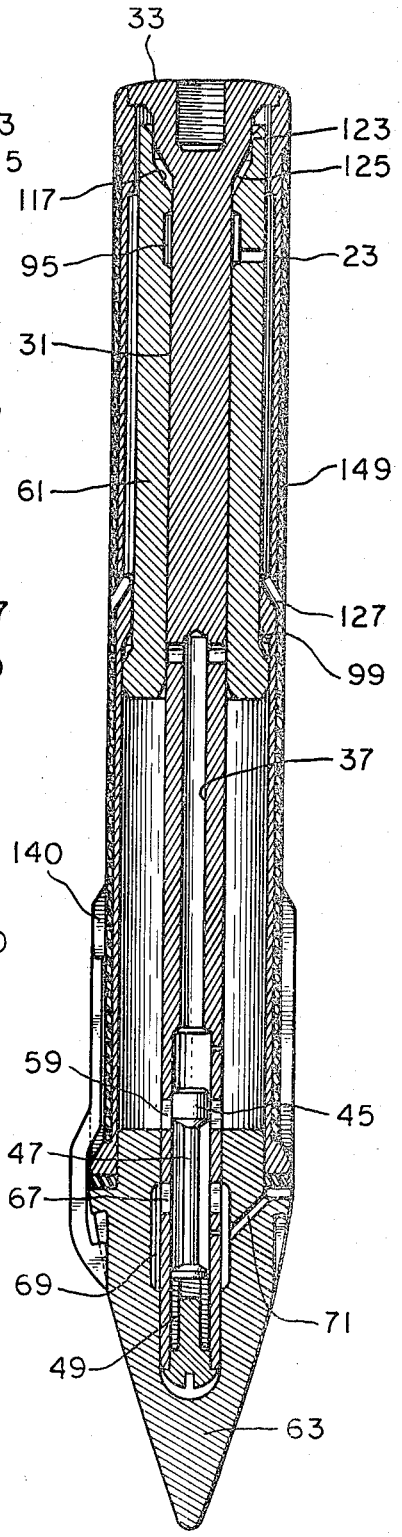

The view of FIG. 8 illustrates the hammer 61 at the end of return stroke, or top-of-stroke, position. The pulse of compressed air that was inserted under the hammer has now expanded and cooled to approximately the value of these parameters for the ambient (or atmospheric) conditions. In the event that the pulse of compressed air provided too much energy, the gas cushion between the surface of the frusto-conical area 117 and the shoulder 125 will preclude any direct contact between the hammer 61 and the casing 23. At this point the spring 49 has urged valve body 45 slightly above the openings 59, so that the space under hammer 61 is now vented to ambient or atmospheric conditions by the path through openings 59, along valve stem 47, through openings 67 to chamber 69, and thence to atmosphere through passageways 71. Therefore, as the hammer begins its blow striking or downward stroke under the force exerted by the compressed air in actuating chamber 99, there will be no compression of the gas under the hammer, as this space is vented to atmosphere for exhausting the expanded gas to atmosphere. The blow striking or down stroke of hammer 61 will exhaust the space below it, but as the gas in the space is expanded and cooled to atmospheric conditions, the gas being exhausted will already be at or near atmospheric conditions.

Figure 9:
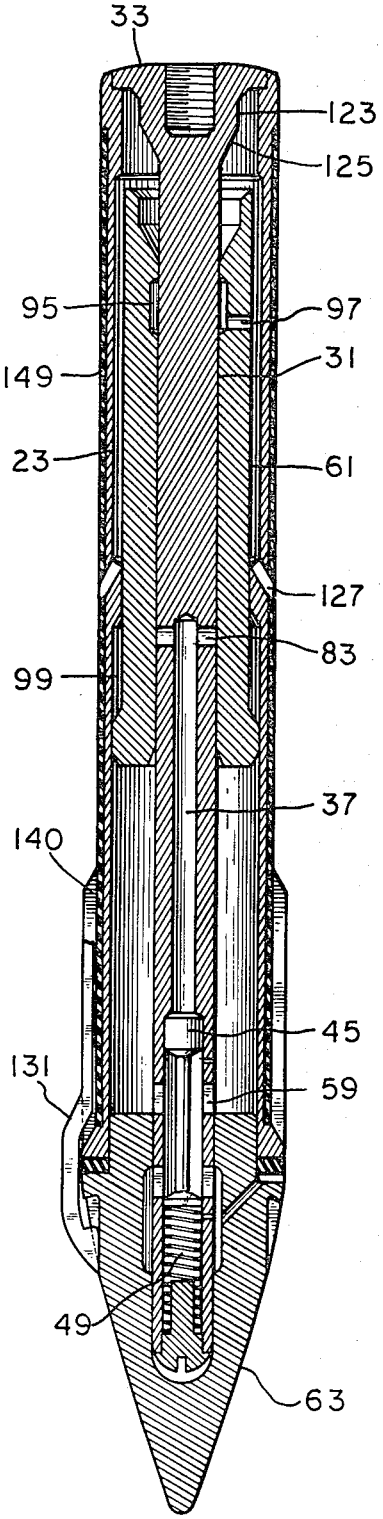
Figure 10:
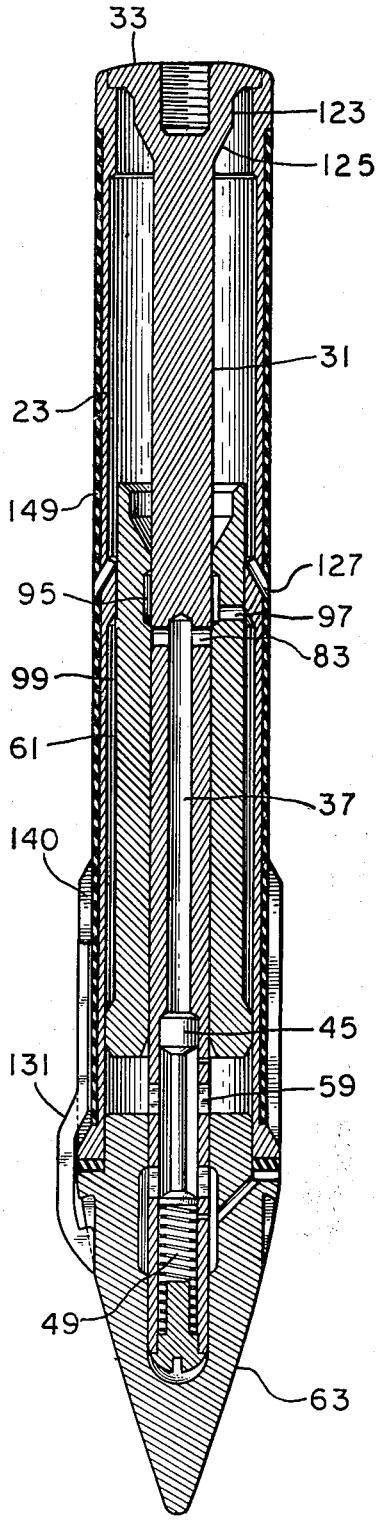

During the initial states of the blow-striking stroke, the valve body 45 continues to be urged away from work bit 63 by spring 49, until it reaches the farthest extent of this motion as shown in FIG. 9. At this point, the openings 59 are completely opened to provide the venting of the space under hammer 61, as previously described. From the position shown in FIG. 8 to that shown in FIG. 10, the hammer 61 is propelled on the blow-striking stroke by the compressed gas in actuating chamber 99 and, in the case of a paving breaker, by the force of gravity. At the position of FIG. 10, the passageways 97 have come into gas conveying position with respect to actuating chamber 99, but chamber 95 has not just come into conjunction with openings 83, so that valve body 45 remains at the extreme position under the force of spring 49.

Figure 11:
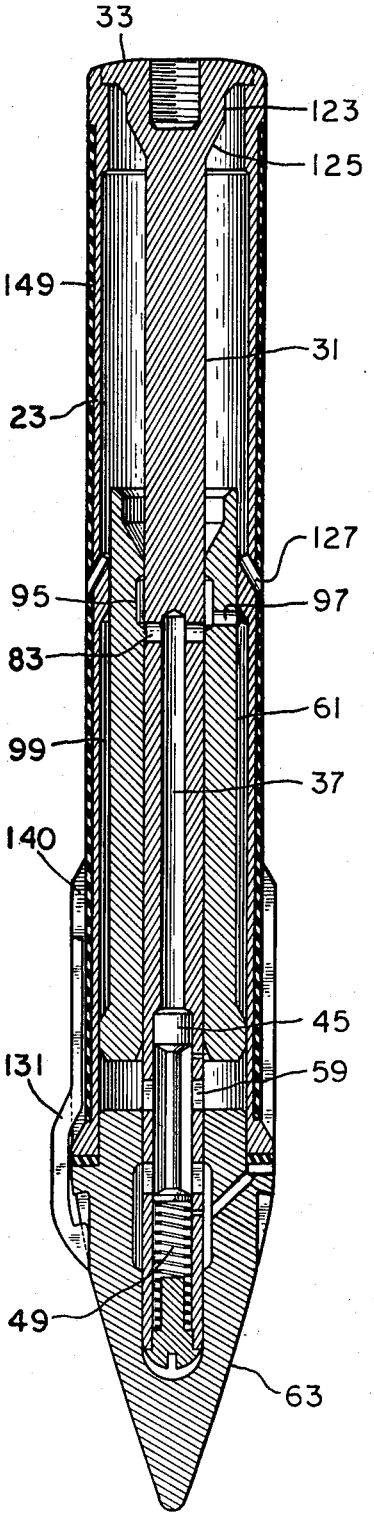
Figure 12:
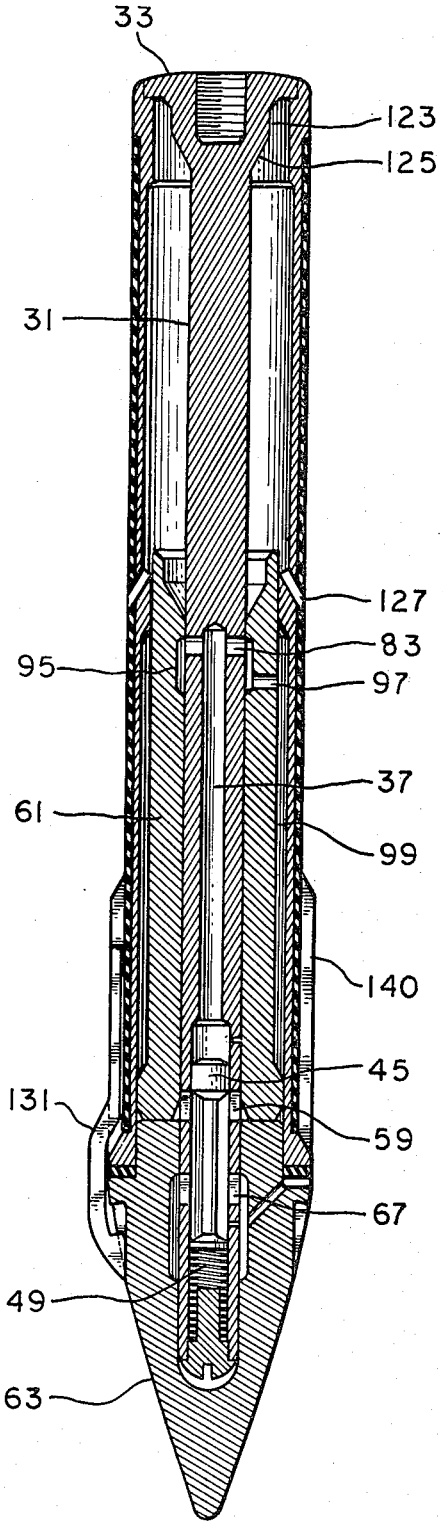
Figure 13:
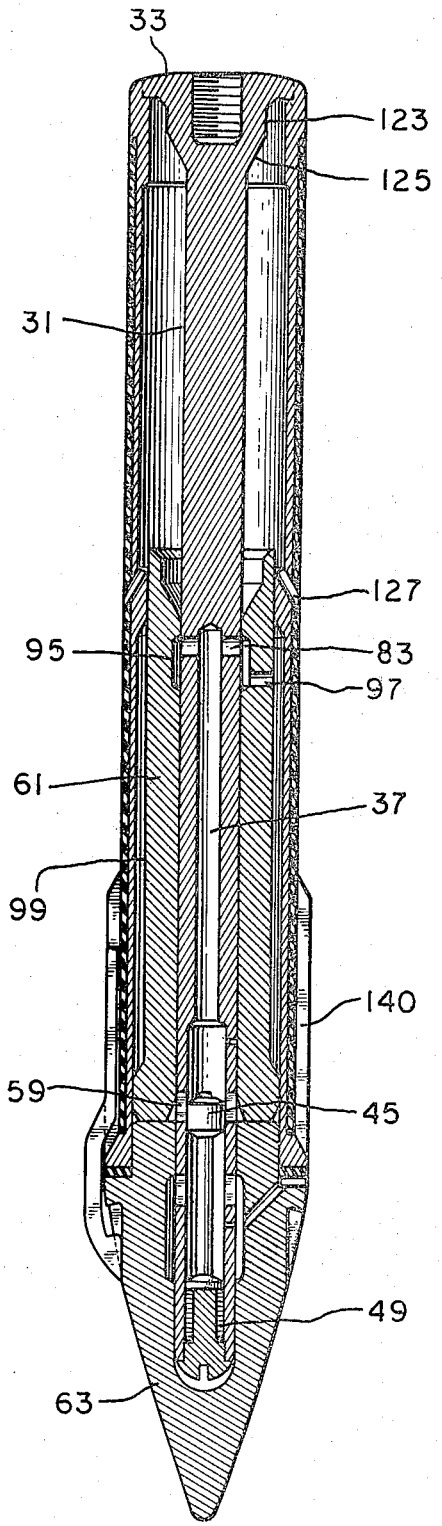

Continued movement to the position of FIG. 11 results in chamber 95 beginning to come into confluence with openings 83 to pass compressed gas to cavity 37. However, the relationship shown has just been reached, so that the pressure in cavity 37 has not yet been raised sufficiently to displace valve body 45 against the force of spring 49. By the time that the position of FIG. 12 has been reached, which is the point at which the hammer 61 comes into blow-striking contact with work bit 63, the chamber 95 has been brought into conjunction with the openings 83 to drive the valve body 45 against the force of spring 49. However, as the conveying of compressed air to cavity 37, and hence against valve body 45, has not caused openings 59 to be closed, these openings still serve to vent the area under hammer 61 to prevent any lessening of the energy conveyed from hammer 61 to work bit 63. A short time later, though, as illustrated in FIG. 13, the compressed air in cavity 37 has resulted in the valve body 45 being moved to close openings 59 as a vent and to open them for the insertion of actuating compressed air. Since hammer 61 has struck work bit 63 and is ready to repeat the cycle of operation just described, it may be seen that a constant force has been maintained against hammer 61 by the compressed gas in actuating chamber 99, which transmits the force from casing 23 when that casing has a force applied to it that is sufficiently great to maintain the resilient member 129 on casing 23 in contact with work bit 63. An energizing propulsion is achieved by applying the same constant pressure compressed gas to a larger surface on the bottom of the hammer 61 and permitting it to expand to drive the hammer against the constant force produced by the gas in actuating chamber 99. Therefore, a vibrationless pneumatically actuated tool is provided which is highly efficient and desirably simple in operation and construction.

In the description of the pneumatic tool 21, it has been pointed out that a greater work output can be achieved if heat energy in the compressed gas is also utilized in driving the hammer. This is particularly true when the operation of the pneumatic tool is considered in conjunction with the operation of the system as a whole, wherein the efficiency of the system is greatly decreased as a result of discarding the heat of compression in the attempted isothermal compression processes conventionally utilized. Accordingly, a much more efficient system can be realized if the heat of compression is conveyed to and utilized in the pneumatic tool. To achieve this highly efficient approach, applicant has produced a truly revolutionary adiabatic compressor, the principles of which are equally applicable in a reverse flow of energy, of which an adiabatic version of the pneumatic tool disclosed herein is an example. Therefore, the description of the adiabatic compressor disclosed herein is generally applicable to the much broader concept of an adiabatic gas-volume transformer (i.e., a device in which substantially adiabatic energy transfer is achieved in either the form of a compressor or a pneumatic motor).

Figure 14:
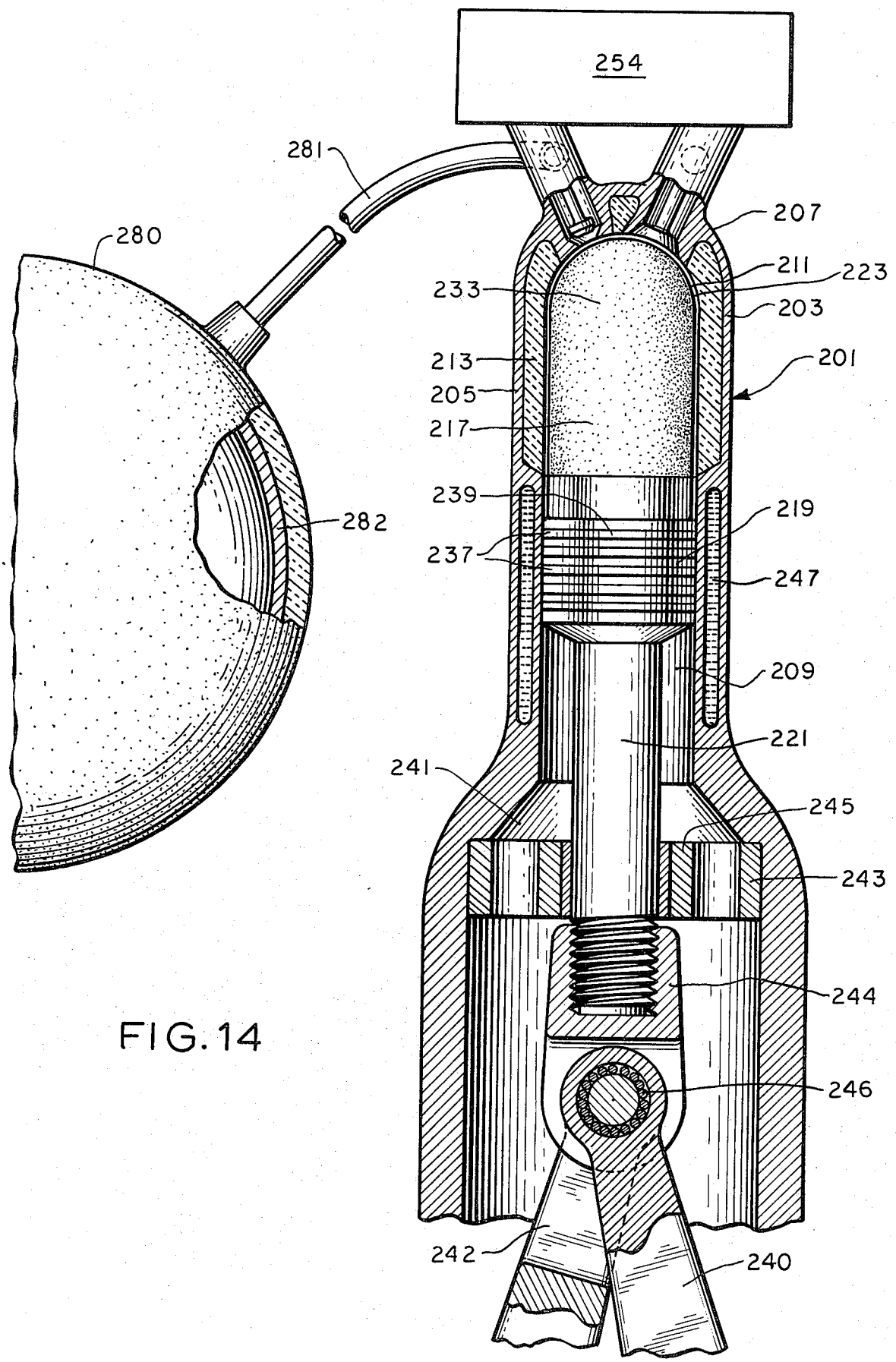
FIG. 14 is a view, partially in elevation and partially in cross-section, of an adiabatic gas transformer system constructed in accordance with the present invention.
Figure 15:
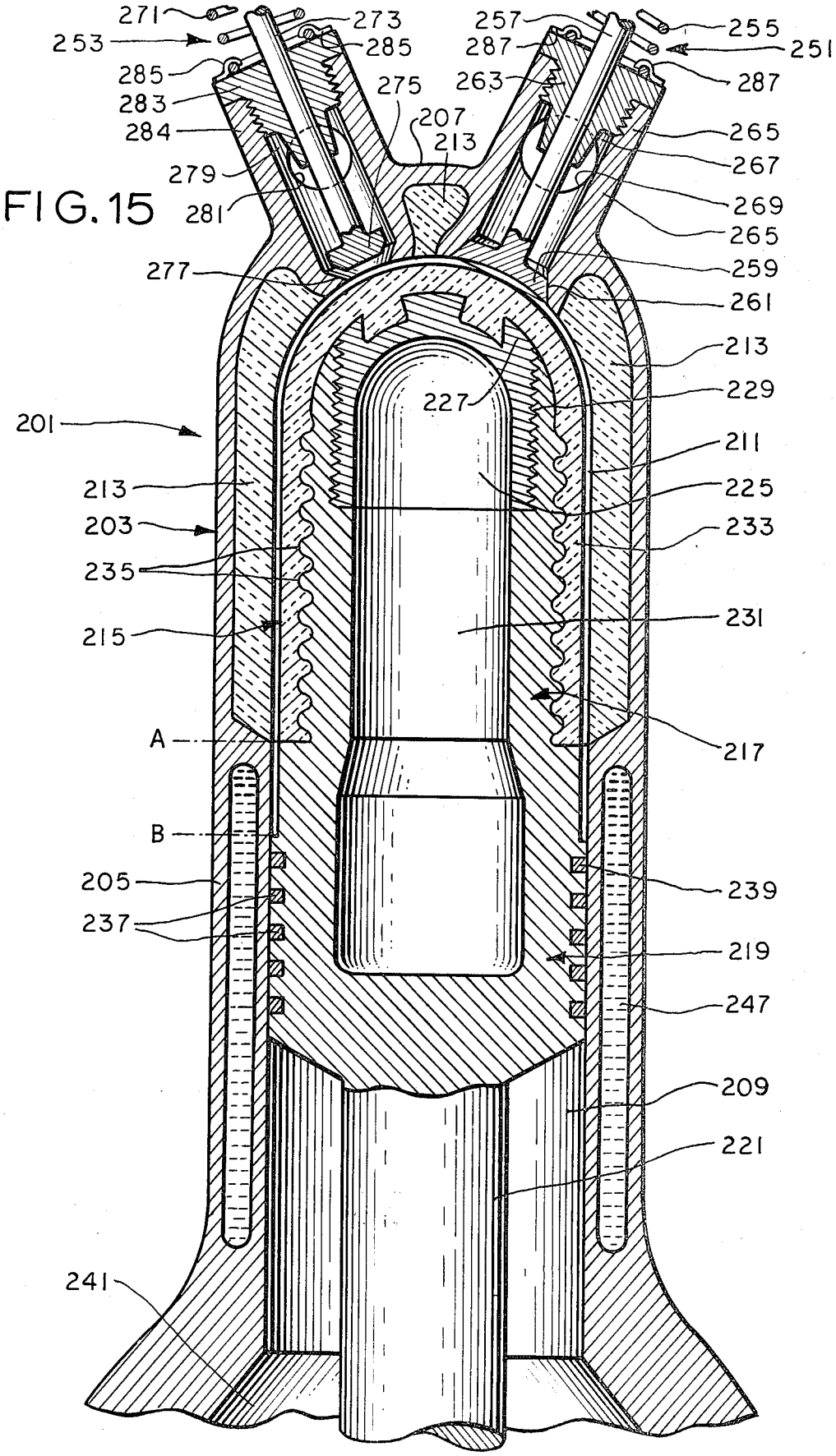
FIG. 15 is an enlarged cross-sectional view of a portion of the transformer of FIG. 14 in its particular form of an adiabatic compressor.
Figure 16:
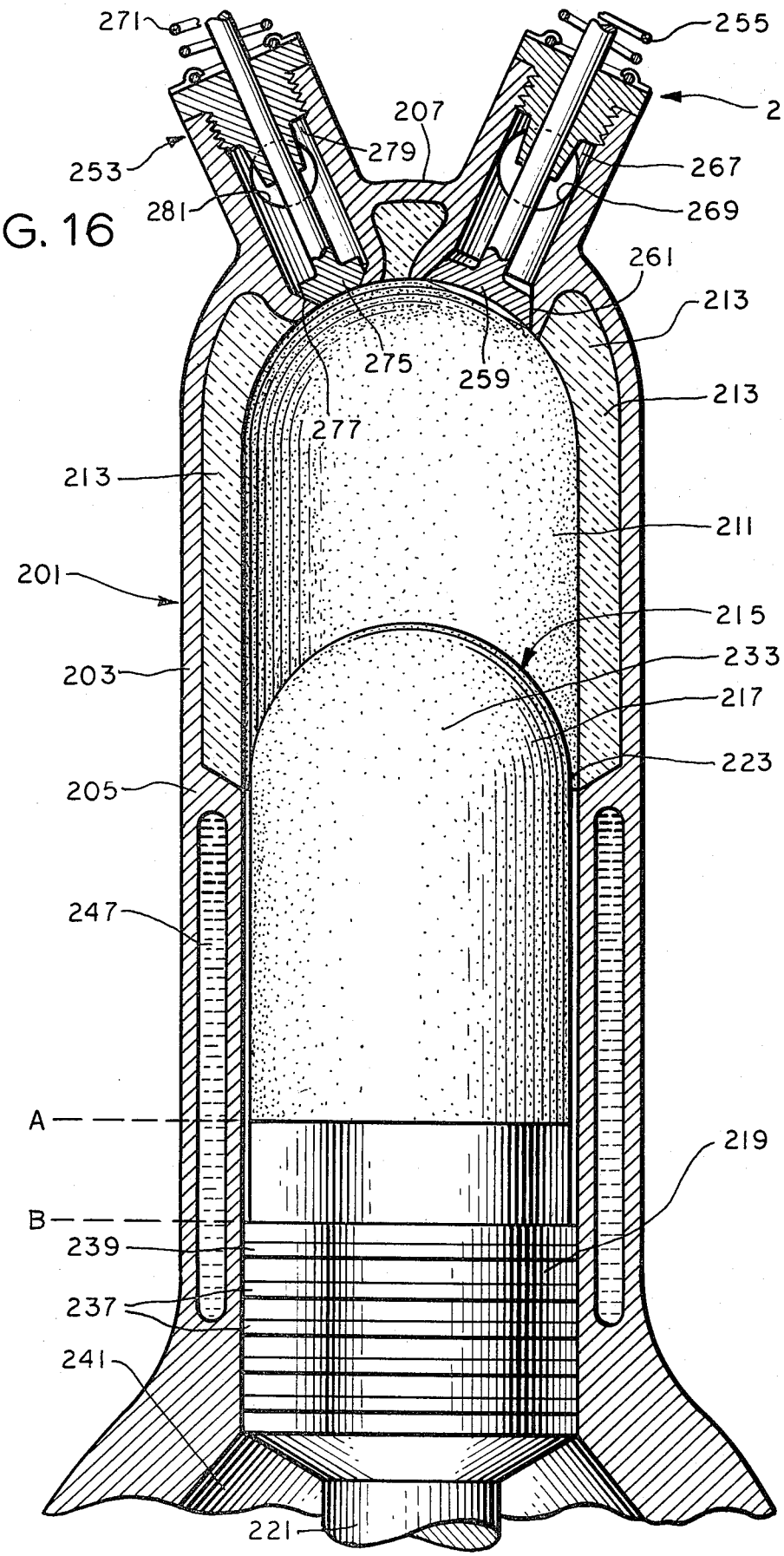
FIG. 16 is another view of the compressor of FIG. 15, partially in cross-section and partially in elevation.

With reference to FIGS. 14, 15 and 16, a preferred embodiment of an adiabatic gas-volume transformer 201 may be seen. In FIGS. 15 and 16, the transformer 201 is depicted in its specialized use as an adiabatic compressor, although the principles are equally applicable to the generalized version of FIG. 14.

Adiabatic gas-volume transformer 201 has an outer casing or shell 203. Casing 203 may be formed of any suitable material having the requisite structural strength, such as steel. The casing 203 has an annular cross-section, generally cylindrical extending portion 205 and a generally hemispherical end portion 207 at one end thereof. It should be recognized that while the preferred embodiment utilizes the shape described for the casing 203, this invention could also be practiced with casings having modified, and even completely different, shapes.

An internal cavity 209 is formed in the casing 203. Cavity 209 has the same general configuration as the casing 203. A portion 211 of cavity 209 at the hemispherical end of the cavity constitutes a gas mass containing space or energy conversion chamber (which is the compression chamber in the specific example of an adiabatic compressor). Energy conversion chamber 211 is encompassed by chamber insulating material 213. Insulating material 213 may be any suitable type of insulation that is capable of enduring the relatively high pressures and temperatures to which it will be subjected in energy conversion chamber 211. In this preferred embodiment, a ceramic type of insulating material 213 has been utilized. Prevention of heat migration or heat loss may also be achieved in any other suitable fashion, such as by very rapid actuation of the apparatus.

A movable element or piston 215 is located in cavity 209 and arranged for longitudinal reciprocation therein. Piston 215 has a first portion 217 insertable into the energy conversion chamber 211, a second portion 219 from which the first portion 217 extends, and a piston shaft 221 extending from the other side of portion 219. All of the portions of piston 215 are integrally connected to form a unitary structure, which is co-axial with casing 203.

Portion 217 of piston 215 is shaped to fit into the energy conversion chamber 211 at the generally hemispherical end of cavity 209. As a matter of fact, this portion 217 actually defines the energy conversion chamber when it is at the bottom of stroke position shown in FIG. 16. The energy conversion chamber 211 may be defined as that portion of cavity 209 which is between the hemispherical end of the cavity and the top of portion 219 of piston 215, less the space displaced by portion 217 of the piston. This definition is made, of course, when the piston 215 is at the bottom-of-stroke position (shown in FIG. 16). It may be seen that there is an additional space about the circumference of part 217 between point 223 and portion 219 of the piston, but as this space is very small and the gas therein does not become an appreciable portion of the gas volume until the top of stroke position is reached by piston 215, it could easily be neglected when defining the energy conversion chamber 211. However, as the gas volume in this space becomes important during the compression stroke at the top of stroke position, it must be included as part of energy conversion chamber 211.

Portion 217 of piston 215 has a central core 225 of a high strength material, such as steel. Core 225 of portion 217 of piston 215 has a plug member 227 at the generally hemispherical end thereof. Plug member 227 is provided with threads 229 to engage corresponding threads in the body of core 225. The purpose of plug 227 is to permit the removal of material from the internal portion of core 225 to form an opening 231, which extends into portion 219 as well. In this way, the piston can be lightened without having to bore through the shaft 221, which would tend to weaken that shaft. After the opening 231 has been formed, plug member 227 is screwed back into the other portion of core 225 to form an integral core for the portion 217.

Piston insulating material 233 is located about the outer surface of core 225, to the same extent as the insulating material 213, in order to prevent any heat loss from the energy conversion chamber through piston 215. Insulating material 233 would be any appropriate type of insulation, such as a suitable ceramic material. Insulation 233 may be more firmly affixed to core 225 by the provision of projections 235, about which insulating material 233 would be formed to provide a more secure connection between this insulating material and core 225.

As may be seen, the external dimensions of portion 217 are made slightly smaller than the dimensions of cavity 209, so that a small gas volume will exist between piston portion 217 and the internal wall of casing 203, even when piston 215 is at the top of stroke position illustrated in FIG. 15. The spacing between the external surface of piston portion 217 and the internal surface of casing 203 is very small, on the order of a few thousandths of an inch. This small spacing, combined with a strict axial alignment of the piston as hereinafter described, is sufficient to keep the insulating materials 213 and 233 from bearing against each other, which could damage the insulating qualities and cause insulating material to accumulate in the energy conversion chamber as a result of abrasion.

Portion 219 of piston 215 is adapted to move in cavity 209 with a tight sliding fit. Piston or sealing rings 237 are located about the periphery of portion 219 to engage the inner surface of casing 203 that forms the cavity 209. A suitable sealing and lubricating medium or agent, such as oil, is in engagement therewith to lubricate the sliding engagement between portion 219 of piston 215 and the inner surface of casing 203, as well as sealing the energy conversion chamber 211 to prevent the escape of gases therein. The sealing and lubricating medium (oil) will be introduced into cavity 209 in any conventional fashion and will be carried by piston ring 237. The pressure of the gas in energy conversion chamber 211 will prevent the oil from rising above the last piston ring 239.

Portions 217 and 219 of piston 215 would ordinarily be integrally formed, although any suitable permanent connection of these portions would be acceptable. Shaft 221 could also be integrally formed with portion 219, but also may be connected in any other fashion to provide a solid and permanent interconnection.

Shaft 221 leads into a crank box 241, wherein mechanical energy can either be transferred to piston 215 or extracted therefrom. In this specific embodiment of a high efficiency adiabatic compressor, an appropriate double-throw crank drive (not shown) may be utilized to reciprocate the piston 215 upwardly to compress the gas in the energy conversion or compression chamber 211. Energy is transferred from the double-throw crank drive by linking rods 240 and 242, which are strong enough to permit high speed operation, if desired. Rods 240 and 242 are connected to shaft 221 through a linking member 244 by means of appropriate bearings, such as needlepoint ball bearings. Member 244 is attached to shaft 221 by any appropriate method, releasable attachment such as a threaded interconnection being desirable for assembly purposes.

In view of the close tolerances between portion 217 of piston 215 and the internal surface of the casing 203, it is necessary that the piston be confined to an extremely accurate co-axial motion between piston 215 and casing 203. Such an accurate co-axial motion may be achieved by utilizing an appropriate guide for the shaft 221, such as a spider structure 243 illustrated in FIG. 14. Spider 243 may be either a three or four-legged spider, as desired. An internal ring 245 of spider structure 243 provides a tight sliding fit with the shaft 221 and must be very accurately positioned to insure the co-axiality of the motion of piston 215 with respect to casing 203.

A cooling jacket or bath 247 is located beyond the end of insulating materials 215 and 233, and extends away from the generally hemispherical end 207 of the casing.

The temperature at which the sealing and lubricating medium that engages piston rings 237 will vaporize is often considerably lower than the relatively high temperatures reached in the energy conversion chamber 211. For example, it would be likely that the lubricant (oil) would have a temperature of vaporization in the vicinity of 400° F., while the temperature in the energy conversion chamber 211 (at full compression or top-of-stroke) could go as high as 6,000° F. Of course, the temperatures in the energy conversion chamber 211 could go considerably higher than this, but as a practical example, the 6,000° clearly illustrates the problem. The cooling jacket 247 maintains a relatively low temperature in the vicinity of the piston rings 237, as well as for a portion of the gas in the energy conversion chamber 211 when the piston 215 is at top-of-stroke, as shown in FIGS. 14 and 15. A very important feature of this invention, which cannot be overemphasized, is the arrangement by which the piston rings 237 have been displaced from the vicinity of the extremely high temperatures reached in the energy conversion chamber 211, as well as by the arrangement for cooling the gas volume in the energy conversion chamber that is adjacent to the piston rings 237.

The cooling jacket or bath 237 may be either located about casing 203, or set in the casing, as shown in this preferred embodiment. This cooling jacket or bath will normally utilize water as the coolant, although other liquid or gaseous cooling mediums could be used equally well.

While this description has been on rather generalized terms that relate to an adiabatic gas-volume transformer, reference has been made to the specific preferred embodiment disclosed herein of an adiabatic compressor. Thus, the particular spring-biased valve assemblies 251 and 253 may be employed, rather than the more generalized arrangement of FIG. 14, which would be a cam arrangement although such a cam arrangement could also be utilized for the specific embodiment of an adiabatic compressor. In valve assembly 251, a compression spring 255 is connected to a valve stem 257. The other end of valve stem 257 is connected to a valve head 259, which is forced against a valve seat 261 by compression spring 255. Valve stem 257 passes through a valve body 263, which is attached to an appropriately threaded flange 265 of casing 203. A valve chamber 267 is formed between the valve body 263 and the valve head 259. An opening 269 brings valve chamber 267 into communication with the atmosphere. When valve head 259 is lifted off valve seat 261, the space between valve head 259 and valve seat 261, the valve chamber 267 and opening 269 form a conduit from energy conversion chamber 211 to the atmosphere.

The valve assembly 253 has a tension spring 271 attached to a valve stem 273, which has a valve head 275 at the other end thereof. Valve head 275 engages a valve seat 277 to seal the energy conversion chamber 211 from a valve chamber 279. A line 281 leads from valve chamber 279 to a tank 280 in which gas at a relatively high pressure and temperature is stores. Tank 280 is preferably insulated, such as by a layer of insulation 282. Although shown in spherical form, tank 280 could, of course, have any appropriate shown shape. Also, the line or conduit 281 is also preferably insulated to prevent loss of heat energy.

When valve head 275 is separated from valve seat 277, the space between valve head 275 and valve seat 277, valve chamber 279 and line 281 provide a flow path between the energy conversion chamber 211 and the gas storage tank 280. As in the case of valve assembly 251, valve assembly 253 has a valve body 283 through which the valve stem 273 passes. Valve body 283 is connected to an appropriate threaded flange 284 on casing 203. In the cases of both compression spring 255 and tension spring 271, the spring is fastened to the respective valve body. In the case of tension spring 271, the spring is connected to valve body 283 by clamps 285, while in the case of compression spring 255, the spring is connected to valve body 263 by clamps 287.

At the bottom-of-stroke position illustrated in FIG. 16, valve head 275 firmly engages valve seat 277. Valve head 259 is forced against valve seat 261 by the relatively weak compression spring 255. Although valve head 259 has been separated from valve seat 261 by the vacuum produced in energy conversion chamber during the down-stroke, the relatively weak compression spring 255 suffices to move valve head 259 to the position shown in FIG. 16 at the bottom of the stroke. This is because at the bottom-of-stroke position the pressure in energy conversion chamber 211 has reached atmospheric level, due to the blow path through opening 269, valve chamber 267 and the space between valve head 259 and valve seat 261. On the other hand, valve head 275 is held in the closed position against valve seat 277 by the pressure of the gas in valve chamber 279 that passes through line 281, as well as by the vacuum created in energy conversion chamber 211 during the down-stroke.

As piston 215 is moved upwardly, the gas in energy conversion chamber 211 is compressed so that the pressure and temperature thereof increase. The increased pressure against valve head 259 keeps valve assembly 251 in the closed condition, so that energy conversion chamber 211 is sealed from the atmosphere. Valve assembly 253 remains in the closed position, as the force due to the pressure of the gas in chamber 211 against the inner surface of valve head 275 is not sufficiently great to overcome the combined force due to the pressure of the gas in valve chamber 279 against the surface of valve head 275 in that chamber and that of the tension spring 271.

As piston 215 reaches the top of stroke position illustrated in FIG. 15, the pressure and temperature of the gas in energy conversion chamber 211 reach the levels that are desired for the gas that is to be transmitted through line 281. At this point the high pressure of the gas in chamber 211 that bears against the inner surface of valve head 275 is sufficiently great to open the valve as shown, to permit the gas in energy conversion chamber 211 to pass through line 281 to the storage tank. As soon as the gas in energy conversion chamber 211 has been transferred through line 281 to the storage tank 280, valve head 275 will be moved to the closed position against valve seat 277. At this point, the system is ready for the down-stroke of piston 215. During the down-stroke, valve head 259 will be moved to the open position away from valve seat 261, as previously explained. At the same time, valve head 275 will be held firmly against valve seat 277 by the pressure of the gas in valve chamber 279 and the force of spring 271, with the strength of the seal being further enhanced by the vacuum formed in energy conversion or compression chamber 211. Therefore, the gas having a relatively high temperature and pressure in the storage tank connected to line 281 will not be permitted to escape into the energy conversion chamber 211. At the bottom-of-stroke position, the valve head 259 will move to the closed position and the sequence of operation previously described will be reinitiated.

As previously explained, one of the significant features of this invention that makes the system operative is the procedures taken for insuring that the lubricating and sealing medium (oil) engaging piston rings 237 is not vaporized by the heat generated during the compression of the gas. This is achieved by two steps: (1) increasing the physical separation between the piston rings 237 and the area where the gas reaches its highest temperature (i.e., adjacent to the hemispherical portion of the cavity 209); and (2) cooling the gas that is closest to the piston rings 237. This latter step is achieved by making the insulation 213 in the casing 203 and the insulation 233 on portion 217 of piston 215 terminate at point A, while the gas extends to point B. Thus, the gas in the volume of energy conversion chamber 211 between points A and B is subjected to the cooling influence of the cooling jacket 247, both through casing 203 and piston portion 219. Assuming that the temperature at point A is the same as the temperature in the hemispherical portion of the energy conversion chamber 211, a temperature gradient between points A and B must be achieved that will reduce the temperature of the gas at point B so that it is below the temperature of vaporization of the sealing and lubricating medium. Due to the very thin film of gas that is in this volume, the cooling effect of the water jacket 247 is more than sufficient to provide the desired temperature gradient. It should be noted that, as a practical matter, the temperature at point A will probably be somewhat less than the maximum temperature in the energy conversion chamber 211, but as the indicated method of protecting the sealing and lubricating medium from high temperatures suffices even in the worst case, the fact that actual conditions might result in less of a temperature gradient between points A and B enhances the significance of this approach.

While the preferred embodiment disclosed herein is that of an adiabatic compressor, it should be recognized that the adiabatic gas-volume transformer may be equally well utilized to provide mechanical power in the fashion of a pneumatic motor. In such an arrangement, the gas at a relatively high pressure and temperature would be inserted into the energy converting chamber 211 through the valve assembly 253 to drive the piston on the down-stroke. During this down-stroke of the piston, the valve assembly 251 would be in the closed position. On the return stroke of the piston, which would be the up-stroke, valve assembly 251 would be open, while the valve assembly 253 would be closed. Obviously, the spring arrangements shown in FIGS. 15 and 16 would not be suitable for such a purpose, and a cam control of the type shown in generalized form in FIG. 14, or some other appropriate type of control, would have to be utilized.

Another interesting and very important concept that is involved in the dual nature of the adiabatic gas-volume transformer is that by utilizing the transformer as a compressor to drive the transformer utilized as a pneumatic motor, it is possible to produce efficiencies in practice that are close enough to the theoretical maximum efficiency of 100% to make such a pneumatic power transmission system very desirable. In this regard, it should be noted that the paving breaker tool described herein may be regarded as a particularized form of the adiabatic gas-volume transformer utilized as a pneumatic motor. Accordingly, use of the adiabatic compressor disclosed herein with the pneumatic paving breaker disclosed herein provides a highly efficient pneumatic system, as well as the freedom from vibration and other desirable characteristics of the paving breaker tool previously set forth.

Figure 17:
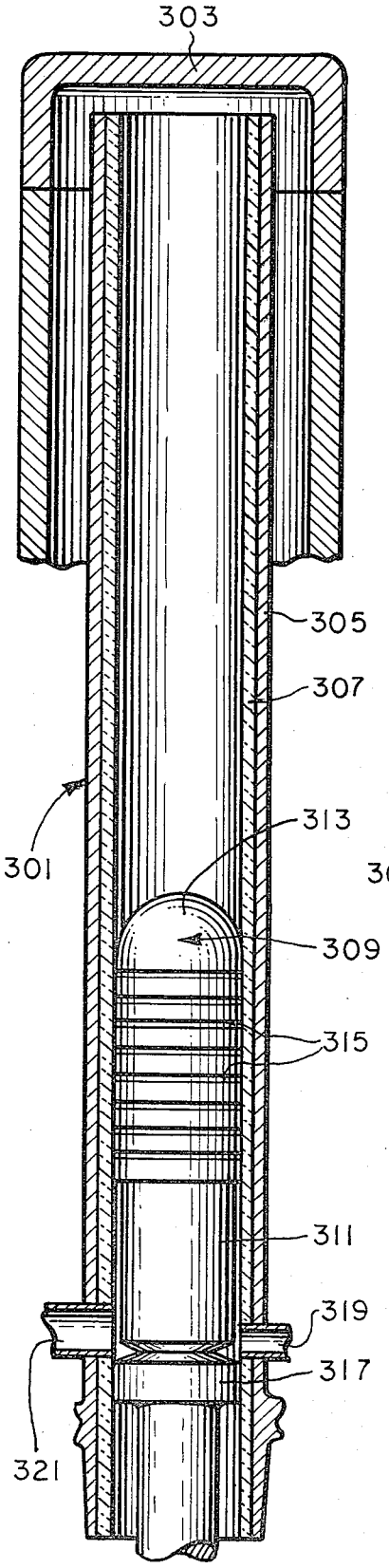
FIGS. 17–19 illustrate, partially in cross-section and partially in elevation, the adiabatic gas-volume transformer in the form of a pneumatic tool.
Figure 18:
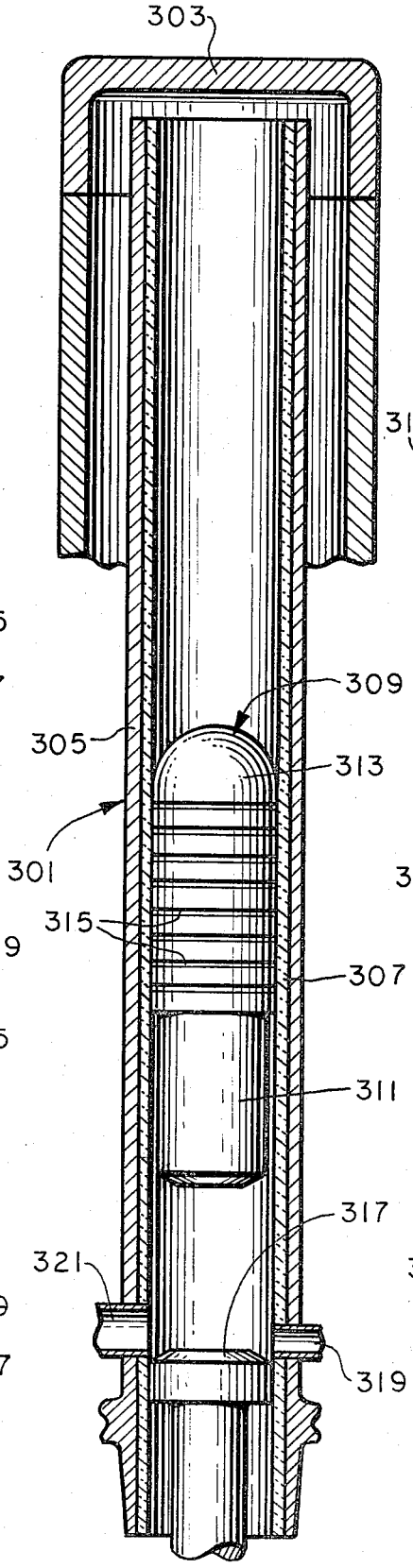
Figure 19:
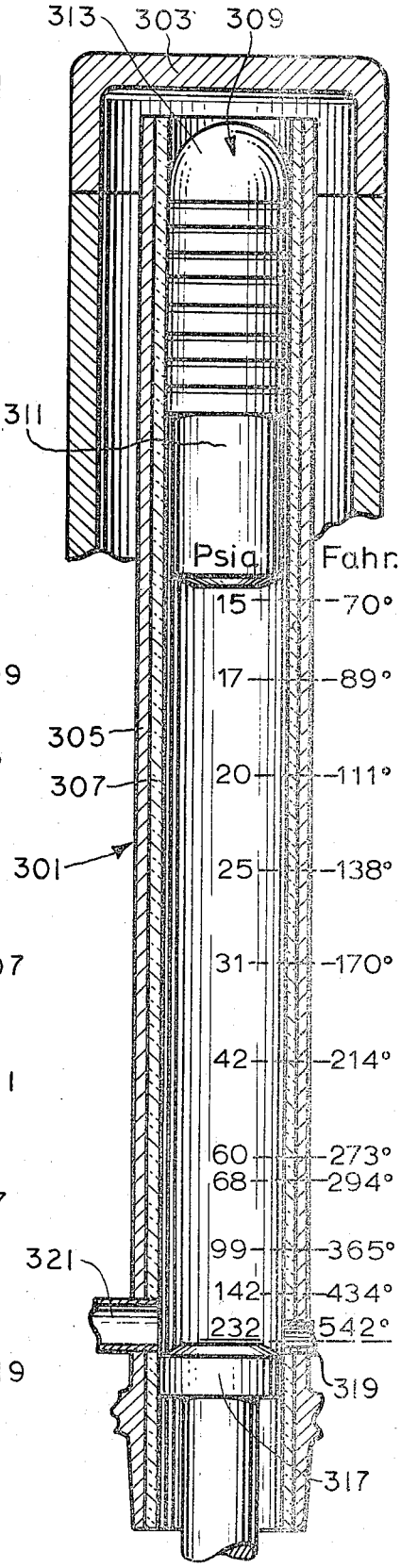

With reference now to FIGS. 17–19, a somewhat schematicized form of a pneumatic tool is illustrated in which the use of the adiabatic gas-volume transformer for transferral of energy in a direction opposite to that involved in compression (i.e., as a pneumatic motor) is disclosed. In the embodiment of FIGS. 1-13, a relatively low temperature is utilized for the heated compressed gas. As the temperature is below the vaporization temperature of the lubricant, there is no necessity of isolating the lubricant from the actuating gas. However, in the embodiment of FIGS. 17-19, much higher temperatures are involved, so that it is necessary to protect the lubricant.

The tool 301 of FIGS. 17-19 has an outer casing 303, of a material such as aluminum, which constitutes a back-up tank. Back-up tank 303 contains a gas at an elevated pressure, but essentially ambient temperature. The utilization of such a back-up tank to keep a constant pressure force applied is disclosed in detail in U.S. Pat. No. 3,266,581—Cooley et al.

An inner casing 305, which is provided with an insulating layer 307, has a movable member or piston 309 therein. Piston 309 has a part 311 thereof which serves as the blow-striking member or hammer. The other portion 313 of piston 309 has piston or sealing rings 315 which are adapted to contact the inner casing 305 with a sliding fit. Piston rings 315 convey a lubricant, such as oil, which forms a film from the top of casing 305 to the bottom of portion 313 of piston 309 at the position shown in FIG. 17. The hammer 311 has a diameter somewhat less than that of portion 313, and thus does not contact the casing 305.

The hammer 311 strikes against an anvil 317, which can either be a portion of the work bit or a separate member driven to strike the work bit. A first conduit 319 provides for the insertion of heated compressed gas (air), while a second conduit 321 provides for venting or exhausting the space between hammer 311 and anvil 317. Appropriate valve systems (not shown) would control the opening and closing of these conduits. It should be noted that the pressure of the gas inserted through conduit 319 is at a greater pressure than the constant pressure of the gas applied to the top surface of piston 309 from back-up tank 303, so that the piston can be raised against the constant force.

For purposes of this discussion, it shall be assumed that the compressed air inserted through conduit 319 has a pressure of 232 psia and a temperature of 542° Fahrenheit. The ambient air shall be assumed to be at 15 psia and 70° F.

At the position shown in FIG. 17, a pulse of the compressed air is inserted through conduit 319. This pulse will have a time duration such that the energy contained therein has been calculated to raise piston 309 to the position shown in FIG. 19, during expansion thereof, against the constant force of the compressed gas from back-up tank 303. As the heated compressed gas is inserted into the casing 305, the temperature of hammer 311 will be raised to 150°. Since the oil film only comes to the bottom of portion 313 of the piston 309, it is not exposed to the 542° of the incoming compressed gas, but only to a temperature of 155°.

As the gas expands and raised piston 309 to the position shown in FIG. 18, the gas also cools. The decrease in temperature and pressure is illustrated for the bottom of hammer 311 in FIG. 19. In the position of FIG. 18, the bottom of hammer 311 is at the level of the lowermost boundary of the oil film (i.e., at the point of the bottom of portion 313 in FIG. 17). From the chart in FIG. 19, it may be seen that the maximum temperature to which the oil film would be exposed would be 294° F., which would be below the temperature of vaporization of the oil. At all other points above this, the oil would be exposed to lesser temperatures, so that no problem of vaporization would result.

Continued expansion and cooling of the pulse of gas that is inserted through conduit 319 raises piston 309 to the position shown in FIG. 19. At this point, conduit 321 is open to the atmosphere to permit exhaustion of the space below the hammer during its downward motion. Since the pulse of air is expanded and cooled to ambient conditions, it will be exhausted at this pressure and temperature level. Therefore, the reverse operation of the adiabatic gas-volume transformer is readily recognized, and it may be seen that all of the energy in the heated compressed gas has been transferred to the piston 309, which is now prepared to release that energy in delivering a blow to the work bit under the constant force of the compressed gas from back-up tank 303. Accordingly, a highly efficient adiabatic system has been demonstrated in which the gas-volume transformer can be utilized at both ends of the system. Of course, the device illustrated in FIGS. 17-19 is rather schematic, but it may be readily recognized that the principles disclosed therein can be readily adapted to many areas.

It should be understood that various modifications, changes and variations may be made in the arrangements, operations and details of construction of the embodiment disclosed herein without departing from the spirit and scope of this invention.

I claim:

1. A high efficiency pneumatic system comprising:

a pneumatic motor;

a drive element in said pneumatic motor having an oscillatory motion, said oscillatory motion being produced by intermittent substantially adiabatic expansion of a gas having pressure and temperature values greater than the ambient pressure and temperature values in order to actuate said drive element against an opposing force;

force transmitting means to convey said opposing force to said drive element without conveying said oscillatory motion of the source of said opposing force;

a compressor in which said gas is compressed substantially adiabatically to retain the heat energy produced during compression;

a conduit to convey said gas from said compressor to said pneumatic motor with a minimal loss of heat energy; and valving means to selectively admit discrete portions of said gas in said conduit to actuate said drive element against said opposing force, said valving means determining that each of said portions of gas admitted by said valving means to actuate said drive element is an amount of gas that will expand to substantially ambient pressure while actuating said drive element to its maximum displacement against said opposing force.

2. A system as claimed in claim 1 wherein said opposing force is a substantially constant force produced by said gas continuously exerting its pressure against a first surface on said drive element, said first surface being smaller than a second surface against which said gas is intermittently expanded to actuate said drive element against said opposing force on said first surface.

3. A system as claimed in claim 2 wherein:

said pneumatic motor is a pneumatic percussive tool; and said drive element is a blow-striking element in said percussive tool.

4. A system as claimed in claim 3 wherein:

said percussive tool is a paving breaker; and said second surface is lower on said blow-striking element thereof than is said first surface, and said gas expands to impinge upon said second surface from below, while bearing on said first surface from above.

5. A system as claimed in claim 4 wherein said substantially constant opposing force is transmitted from a handheld casing by said gas.

6. A system as claimed in claim 1 wherein said conduit is an insulated hose.

7. A high efficiency pneumatic system comprising:

a pneumatic motor;

a drive element in said pneumatic motor having an oscillatory motion, said oscillatory motion being produced by intermittent substantially adiabatic expansion of a gas having pressure and temperature valves greater than the ambient pressure and temperature valves in order to actuate said drive element against an opposing force;

force transmitting means to convey said opposing force to said drive element without conveying said oscillatory motion to the source of said opposing force;

a gas mass confining chamber;

a movable element to vary the gas-containing volume of said chamber to compress gas therein;

heat migration preventive means to prevent loss of heat energy from said gas in said chamber so that said gas is compressed substantially adiabatically to retain the heat energy produced during compression;

a conduit to convey said gas from said gas mass confining chamber to said pneumatic motor with a minimal loss of heat energy;

valve means to insert heated compressed air into said conduit from said chamber; and valving means to selectively admit discrete portions of said gas in said conduit to actuate said drive element against said opposing force, said valving means determining that each of said portions of gas admitted by said valving means to actuate said drive element is an amount of gas that will expand to substantially ambient pressure while actuating said drive element to its maximum displacement against said opposing force.

8. A system as claimed in claim 7 wherein:

said pneumatic motor is a paving breaker;

said drive element is a hammer in said paving breaker;

said opposing force is substantially constant and is produced by continuously applying said gas to a first, relatively smaller surface on said hammer; and said gas is expanded against a second, relatively larger surface, facing in the opposite direction from said first surface to actuate said hammer against said constant opposing force.

9. A pneumatic tool system in which undesired transmission of vibrations is eliminated and comprising:

an outer casing in which vibrations are undesired;

a vibrating generally cylindrical blow-striking hammer having generally annular cross-section reciprocable in said outer casing;

a source of gas at a constant pressure in excess of atmospheric pressure and a temperature greater than ambient temperature;

a coupling chamber into which said gas is introduced to transmit a substantially constant force from said outer casing to said hammer, the magnitude of the coupling chamber force applied to said hammer being determined by the pressure of said gas and a first pressure surface associated with said hammer;

a round rod coaxial with said outer casing over which said hammer passes; and a valve assembly in said round rod to control application of said gas to a second pressure surface under said hammer for a predetermined period of time, said second pressure surface being larger than said first pressure surface so that said hammer is driven against the coupling chamber force applied thereto to effectuate the up-stroke of said hammer, said valve assembly also controlling venting of the space under said hammer of exhausting this space during the downstroke of said hammer.

10. Apparatus as claimed in claim 9 wherein said coupling chamber is formed between said hammer and said outer casing with opposing surfaces located, respectively, on said outer casing and said hammer to provide for the transmission of said substantially constant force from said casing to said hammer.

11. Apparatus as claimed in claim 10 wherein said substantially constant force is provided by an operator holding said casing with a force in excess of a mininum force necessary to overcome the pressure of said gas.

12. Apparatus as claimed in claim 9 wherein said source of gas is a compressor in which said gas is substantially adiabatically compressed.

13. A vibrationless pneumatic paving breaker system comprising:

a source of compressed gas at a temperature greater than ambient temperature;

a casing having a force applied thereto;

a conduit to convey the compressed gas from said source to said casing;

a generally cylindrical hammer having a generally annular cross section arranged for reciprocable motion in said casing;

a work bit to break paving upon being struck by said hammer, said work bit being mounted for motion with respect to said casing;

restraining means to prevent separation of said work bit from said casing;

an actuating chamber into which said gas is inserted formed between said casing and said hammer with respective opposing surfaces on said casing and said hammer to transmit said force applied to said casing to said hammer, the transmitted force having a constant value dependent upon the pressure of said gas;

a round rod coaxial with said casing, said hammer reciprocating along said round rod; and a valve assembly located in a cavity in said round rod and adapted selectively to cause said gas to be inserted under said hammer for a predetermined period of time to impinge upon a surface larger than said opposing surfaces in said actuating chamber to drive said hammer against said constant transmitted force as said gas expands, and to vent the space under said hammer to permit the expanded gas to be exhausted.

14. A system as claimed in claim 13 wherein said valve assembly is located in a cavity in said round rod and comprises:

a valve body mounted for reciprocation in said cavity and adapted to control gas flow to and from the space under said hammer;

a gas flow path to pass said compressed gas to said cavity, and hence to bear against said valve body, at selected times; and a bias spring to urge said valve body in the opposite direction it is driven by said compressed gas in said cavity but with a lesser force.

15. a system as claimed in claim 14 wherein said gas flow path comprises:

an opening from said cavity to the exterior of said round rod;

a chamber extending a desired distance along the inner surface of said hammer and adapted to be in periodic communication with said opening as said hammer reciprocates; and a passageway through said hammer to said actuating chamber, said predetermined period of time during which said gas is inserted under said hammer being established by the duration of communication between said chamber and said opening.

16. A system as claimed in claim 13 and further comprising means to provide that said work bit is spaced from said casing by the force of the gas in said actuating chamber when the force is removed from said casing, the corresponding displacement of said hammer resulting in the paving breaker being rendered inoperative until the force is reapplied to said casing.

17. A system as claimed in claim 13 and further comprising an insulating medium positioned about at least a portion of said casing to prevent loss therefrom.

18. A system as claimed in claim 13 and further comprising venting means to maintain the space above said hammer at ambient pressure.

19. A system as claimed in claim 13 wherein said source of compressed gas is a substantially adiabatic compressor.

20. A high efficiency pneumatic system comprising:

a pneumatic motor;

a drive element in said pneumatic motor having an oscillatory motion;

means for raising the pressure and temperature of a quantity of air drawn from the atmosphere to values above the pressure and temperature of the atmosphere;

a conduit to convey air from said quantity of air, at a pressure and temperature above the pressure and temperature of the surrounding atmosphere, to said pneumatic motor with a minimal loss of heat energy; and valving means to selectively admit discrete portions of said air to said conduit to actuate said drive element against an opposing force, said valving means determining that each of said portions of air admitted by said valving means to actuate said drive element is an amount of air that will expand to substantially atmospheric pressure and temperature while actuating said drive element to its maxium displacement against said opposing force.

21. A pneumatic system as claimed in claim 20 wherein said means for raising the pressure and temperature of said quantity of air comprises:

a compressor to draw said quantity of air from the atmosphere and compress it; and insulation to prevent loss of the heat of compression from said compressor and said conduit.

22. A pneumatic tool system comprising:

a tool casing;

a blow-striking member positioned for reciprocable motion in said tool casing;

a work member to be struck by said blow-striking member;

means for raising the pressure and temperature of a quantity of air drawn from the atmosphere to values above the pressure and temperature of the atmosphere;

a conduit to convey air from said quantity of air, at a presssure and temperature above the pressure and temperature of ambient air, to said tool casing with a minimal loss of heat energy; and valving means to selectively admit discrete portions of said air in said conduit to drive said blow-striking member away from said work member against an opposing force, said valving means determining that each of said portions of air admitted by said valving means to drive said blow-striking member is an amount of air that will expand to substantially ambient pressure and temperature while driving said blow-striking member to its maximum displacement against said opposing force, whereby the air driving said blow-striking member is exhausted at substantially ambient pressure to eliminate the major source of noise in a pneumatic tool.

23. A pneumatic tool system as claimed in claim 22 wherein said means for raising the pressure and temperature of said quantity of air comprises:

a compressor to draw said quantity of air from the atmosphere and compress it; and insulation to prevent loss of the heat of compression from said compressor and said conduit.

24. A pneumatic tool system as claimed in claim 22 wherein said opposing force is a force applied to said casing and transmitted to said blow-striking member by a coupling chamber containing some of said quantity of air.

25. A pneumatic tool system as claimed in claim 24 wherein:

said blow-striking member is a generally cylindrical hammer having a generally annular cross-section;

a generally round rod is coaxial with said casing and mounted internally of said hammer; and said valving means is located in said round rod.

26. A pneumatic tool, in which undesired transmission of vibrations and exhaust noise are substantially eliminated, comprising:

an outer casing in which vibrations are undesired and to which an operating force is applied;

a vibrating blow-striking hammer reciprocable in said outer casing, reciprocation of said hammer being produced by intermittent substantially adiabatic expansion of a gas having pressure and temperature values greater than the ambient pressure and temperature values in order to actuate said hammer against said operating force;

force transmitting means to convey said operating force to said hammer without conveying the vibrations of said hammer to said casing; and valving means to selectively admit discrete portions of said gas to actuate said hammer against said operating force, said valving means determining that each of said portions of gas admitted by said valving means to actuate said hammer is an amount of gas that will expand to substantially ambient pressure while actuating said hammer to its maximum displacement against said operating force.

27. A pneumatic tool as claimed in claim 26 wherein said force transmitting means comprises:

an actuating chamber into which said gas at a constant pressure in excess of atmospheric pressure and a temperature greater than ambient temperature is introduced to transmit said operating force as a substantially constant force from said casing to said hammer; and a first pressure surface associated with said hammer, the magnitude of said substantially constant force applied to said hammer being determined by the pressure of said gas in said actuating chamber and said first pressure surface.

28. A pneumatic tool as claimed in claim 27 wherein said actuating chamber is formed between said hammer and said casing with opposing surfaces located, respectively, on said casing and said hammer to provide for the transmission of said substantially constant force from said casing to said hammer.

29. A pneumatic tool as claimed in claim 27 wherein said valving means comprises:

a round rod coaxial with said outer casing over which said hammer passes; and a valve assembly in said round rod, said valve assembly controlling insertion of said gas to a second pressure surface under said hammer for a predetermined period of time, said second pressure surface being larger than said first pressure surface so that said hammer is driven against said substantially constant force applied thereto to effectuate the up-stroke of said hammer while expanding the gas inserted under said second surface during said predetermined time to substantially atmospheric pressure and temperature, said valve assembly also controlling venting of the space under said hammer for exhausting this space during the down-stroke of said hammer.

30. A pneumatic tool as claimed in claim 29 wherein:

the pneumatic tool is a paving breaker;

a work bit to break paving is struck by said hammer, said work bit being mounted for motion with respect to said outer casing; and restraining means is provided to prevent separation of said work bit from said casing.

31. A pneumatic tool as claimed in claim 30 wherein said valve assembly is located in a cavity in said round rod and comprises:

a valve body mounted for reciprocation in said cavity and adapted to control gas flow to and from the space under said hammer;

a gas flow path to pass said compressed gas to said cavity, and hence to bear against said valve body, at selected time; and a bias spring to urge said valve body in the opposite direction to that in which it is driven by said compressed gas in said cavity but with a lesser force.

32. A pneumatic tool as claimed in claim 31 wherein said gas flow path comprises:

an opening from said cavity to the exterior of said round rod;

a control member extending a desired distance along the inner surface of said hammer and adapted to be in periodic communication with said opening as said hammer reciprocates; and a passageway through said hammer to said actuating chamber, said predetermined period of time during which said gas is inserted under said hammer being established by the duration of communication between said control chamber and said opening.

33. A pneumatic tool as claimed in claim 32 wherein the positioning of said opening and the opposing forces on opposing surfaces forming said actuating chamber provide safety means to prevent operation of the paving breaker unless an operating force of sufficient magnitude is applied to said outer casing to overcome the force between said casing and said work bit produced by the pressure of said gas in said actuating chamber.

34. A pneumatic tool as claimed in claim 26 and further comprising an insulating medium positioned about at least a portion of said outer casing to prevent heat loss therefrom.

35. A pneumatic tool as claimed in claim 26 and further comprising venting means to maintain the space above said hammer at ambient pressure.

* * * * *